US005144521A

United States Patent [19]

Tagoku et al.

[11] Patent Number: 5,144,521

[45] Date of Patent: Sep. 1, 1992

[54] DISCHARGING MEMBER AND CHARGING DEVICE USING THE SAME

[75] Inventors: Izumi Tagoku; Eishu Ohdake, both of Tokyo, Japan

[73] Assignee: Ricoh Company, Ltd., Tokyo, Japan

[21] Appl. No.: 458,073

[22] Filed: Dec. 28, 1989

[30] Foreign Application Priority Data

Dec. 28, 1988 [JP] Japan ..... 63-328805
Jan. 18, 1989 [JP] Japan ..... 1-7633

[51] Int. Cl.[5] ..... H01T 23/00

[52] U.S. Cl. ..... 361/225; 250/326; 335/219; 338/217; 361/230

[58] Field of Search ..... 361/212, 220, 225, 230; 355/219; 250/324, 325, 326; 385/221-226; 338/20, 21, 217

[56] References Cited

U.S. PATENT DOCUMENTS 4,558,334 12/1985 Fotland ..... 250/326

FOREIGN PATENT DOCUMENTS 0040846 4/1981 Japan ..... 355/219
0032274 2/1985 Japan ..... 355/219
0172182 7/1988 Japan ..... 355/219

*Primary Examiner*—Jeffrey A. Gaffin
*Attorney, Agent, or Firm*—Oblon, Spivak, McClelland, Maier & Neustadt

[57] ABSTRACT

A charging device for charging a desired object such as a photoconductive element of an electrophotographic copier, laser printer or similar electrophotographic recording apparatus, and a discharging member of the same. The discharging member is implemented by a resistor and located such that the surface of one end thereof defines a discharging end that faces the object with the intermediary of a gap. The other end of the discharging member is connected to a power source via a conductive connector. The discharging end is provided with any one of various alternative configurations. The resistor is covered with a protective covering. A conductive member is adhered or otherwise securely mounted between the resistor and the conductive connector. The resistor is supported by an insulative substrate. On the substrate, the resistor is divided into a plurality of discrete resistors so as to form a plurality of discharge gaps therebetween which are selectively usable. The resistor has a plurality of discharging ends each defining a different charging width.

36 Claims, 20 Drawing Sheets

DISCHARGING MEMBER AND CHARGING DEVICE USING THE SAME

BACKGROUND OF THE INVENTION

The present invention relates to a discharging member and a charging device using the same which are applicable to an image forming apparatus of the type having a photoconductive element or similar image carrier or an electrostatic recording member or similar electrostatic recording member.

An electrophotographic copier, facsimile machine, laser printer or similar electrophotographic recording apparatus has a photoconductive element or similar image carrier or an electrophotographic recording sheet or similar recording medium, and a charging device for charging the image carrier or the recording medium. Typical of charging devices known in the art are a corotron charger and a scorotron charger which belong to a family of corona chargers. Such a corona charger has a casing, a charging member in the form of a thin wire which is made of tungsten or molybdenum and arranged at the center of the casing, and a high-tension power source for applying a high voltage across the wire and casing. The wire is located at a predetermined distance from the photoconductive element or similar object to be charged. When a high voltage is applied across the wire and casing, a corona discharge occurs between the wire and the casing. Then, ions are emitted from the wire and deposited on the object to thereby charge the latter. A problem with this kind of corona charger is that about 80% of the released ions flows toward the casing, resulting in poor charging efficiency. Should the casing be absent, however, it would be difficult to effect the discharge unless an extremely high voltage was applied across the wire and casing. Reducing the distance between the wire and the object may be successful in lowering the required voltage. This, however, brings about another problem that unnoticeable undulations on the surface of the object are apt to cause a non-uniform charge distribution or undesired spark discharge to occur.

Discharges in the atmosphere are always accompanied by the generation of ozone. A large amount of ozone is injurious not only to health but also to mental hygiene because it has an offensive smell. Even the discharge between the wire and the casing as mentioned above produces ozone. Therefore, enhancing efficient use of ions issuing from the wire is desirable in reducing harmful ozone. Besides, the discharge start voltage increases with the increase in the distance between the wire and the object and with the decrease in the distortion of an electric field which is developed near the wire. Then, a higher voltage would be required to insure a necessary amount of charge and a necessary discharge current, aggravating the generation of ozone. From the fact that the discharge start voltage increased with the decrease in the distortion of the electric field which is developed near the discharging member, i.e., wire, it will be seen that a conductive and/or flat discharging member increases the amount of ozone. A drawback particular to a corotron charger or similar charger using a thin wire is that the wire itself is not mechanically strong and is apt to loose elasticity due to aging such as oxidation and degeneration. In the worst case, such a wire will be broken while the apparatus is in operation.

SUMMARY OF THE INVENTION

It is therefore an object of the present invention to provide a discharging member which enhances efficient use of energy, minimizes the generation of ozone, and frees an object to be charged from mechanical, physical and chemical damage, and a charging device using the same.

It is another object of the present invention to provide a generally improved discharging member and charging device using the same.

A discharging member located to face an object with the intermediary of a gap for charging, with a voltage being applied from a power source to each of the discharging member and object, the surface of the object by a discharge which occurs in the gap of the present invention comprises a body, a resistor constituting one end of the body and defining a discharging end which faces the object with the intermediary of the gap, and a connecting end connected to the power source at the other end of the body.

A charging device applied with a voltage from a power source for charging a surface of an object by a discharge which occurs between the charging device and the object of the present invention comprises a resistor one end of which defines a discharging end facing the object with the intermediary of a gap, and a conductive connector connecting the resistor to the power source at the other end of the resistor.

Also, a charging device applied with a voltage from a discharge power source for charging the surface of an object by a discharge which occurs between the charging device and the object of the present invention comprises a flat substrate, and a pair of discharging elements supported on the substrate, at least one of the discharging elements which define at least one discharge gap being constituted by a resistor.

Further, a charging device applied with a discharge voltage from a discharge power source for charging a surface of an object by a discharge which occurs between the charging device and the object of the present invention comprises a substrate having a polygonal cross-section, and a plurality of discharging elements each being provided on respective one of surfaces of the substrate, at least one of the discharging elements provided on adjoining ones of the surfaces comprising a resistor and defining one discharge gap between the one discharging element and the other discharging element adjoining the one discharging element.

Yet, a charging device applied with a discharge voltage from a discharge power source for charging a surface of an object by a discharge which occurs between the discharging element and the object of the present invention comprises a plurality of discharging elements comprising resistors arranged in parallel with each other, one end of each of the discharging elements constituting a discharging end that faces the object with the intermediary of a gap, and a conductive member holding the other end of the plurality of discharging members for applying the discharge voltage from the discharge power source to the discharging ends.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
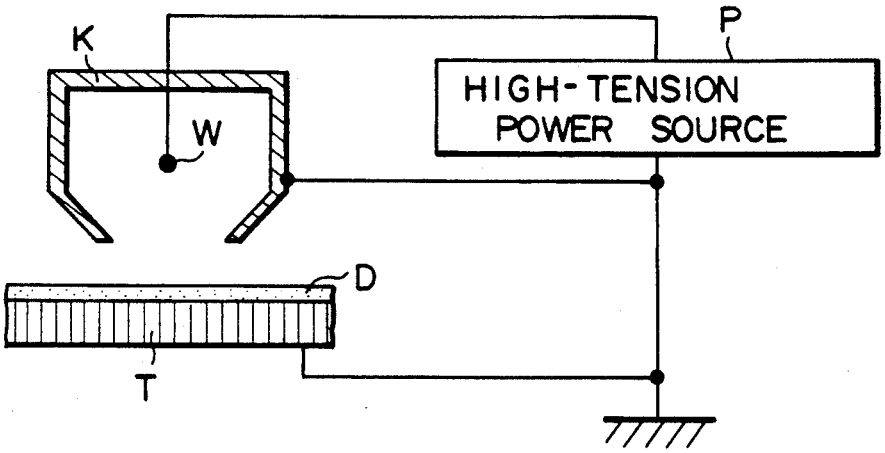
FIG. 1 PRIOR ART
FIG. 1 is a view showing a prior art charging device schematically.

To better understand the present invention, a brief reference will be made to a prior art discharging member and a charging device using it, shown in FIG. 1. As shown, the prior art charging device is implemented as a corotron charger by way of example and has a casing K and a wire W. The wire W is made of tungsten or molybdenum and arranged substantially at the center of the casing K. A high-tension power source P applies a high voltage across the wire W and casing K to generate a discharge therebetween. Then, ions are released from the wire W and deposited on an object D which is laid on a conductive table T, for example. As a result, the object D is charged by the ions. Such a prior art device has various problems left unsolved, as discussed earlier. Specifically, an extremely high voltage has to be applied to the wire W in order to efficiently deposit ions emitted from the wire W on the object D. Should this problem be solved by reducing the distance between the wire W and the object D, another problem would be brought about that non-uniform charging or undesired spark discharge is apt to occur due to fine undulations on the object D. The high voltage applied to the wire W aggravates the generation of ozone. The service life of the wire W itself is short.

Various embodiments of the present invention which are free from the drawbacks discussed above will be described with reference to FIG. 2 and successive figures.

First, the subject matter of the present invention will be described with reference to FIG. 2 which shows a first embodiment of the present invention implemented by a flat resistor R. As shown, a charge from a power source P is propagated through a conductive connector C and resistor R and along the surface of the resistor R. From the discharging end t of the resistor R, the charge is released in the form of ions by a corona discharge to in turn charge an object D. FIG. 3 shows an equivalent circuit useful for understanding the principle of the present invention. The equivalent circuit has a resistor r representative of the resistor R which is a discharging member, a capacitor c representative of the capacitance between the discharging end t of the discharging member and the object D, and a Zener diode z representative of a discharge start voltage across the discharging end t and object D. Assuming that the voltage from the power source P sequentially increases, the capacitor c is continuously charged until voltage reaches the charge start voltage. As soon as the terminal voltage of the capacitor C exceeds the discharge start voltage, i.e., the conduction start voltage of the Zener diode z, a discharge begins to occur between the discharging member and the object. A current flowing through the Zener diode z is representative of the discharge current. This current flows through the resistor R and usually has a value of several tens to several thousands of microamperes. In practice, on the beginning of the discharge between the discharging end t and the object D, the gap defined therebetween is substantially ionized. In this condition, the effective resistance of the discharge resistor corresponding to the conduction resistance of the Zener diode z is lowered to a noticeable extent.

Figure 4A:
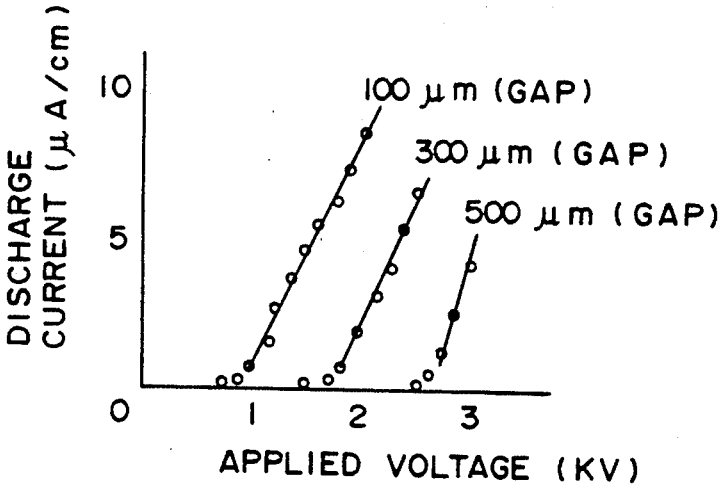
FIGS. 4A and 4B are graphs indicative of characteristics of the charging device in accordance with the present invention.
Figure 4B:
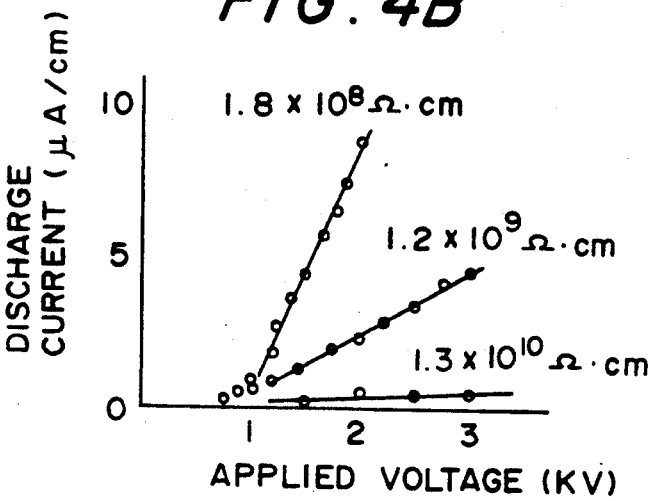

FIGS. 4A and 4B are graphs showing the characteristics of a corona discharge particular to the present invention. Specifically, FIG. 4A shows a relationship between the applied voltage and the discharge current determined by maintaining the resistance of the resistor R per unit length at $1.8\times10^8$ Ω·cm and varying the dimension of the discharge gap to 100 μm, 300 μm, and 500 μm. On the other hand, FIG. 4B shows the same relationship which was determined by maintaining the dimension of the discharge gap at 100 μm and varying the resistance of the resistor R per unit length to $1.8\times10^8$ Ω·cm, $1.2\times10^9$ Ω·cm, and $1.3\times10^{10}$ Ω·cm. As the curves of FIGS. 4A and 4B indicate, the discharge start voltage depends on the dimension of the discharge gap. Although the gradient of discharge start voltages is dependent on the resistance r of the resistor R, it is linear without exception.

The resistor R may be implemented by any of organic substances such as plastics and high-molecular rubber, or any of inorganic substances such as glass, metal oxides and ceramics. While these substances are generally electrically insulative, they will have a desired resistance when an ion material for polar radical substitution or an electronically conductive material implemented as fine particles of metal or carbon is added thereto. Another advantage of such substances is that they can be molded or cut into a desired configuration. Organic substances, in particular, withstand heat and allows a solvent to be applied and then dried thereon. Ceramics can be rolled into a sheet configuration so as to form a resistor on an insulative material, or the resistor itself can be rolled into a sheet configuration.

The resistor R of the kind described above forms an infinite matrix of resistance between the conductive connector C and the discharging end t. Such a matrix of resistance eliminates local discharge breakdown which is particular to a conductive discharging electrode. Even if the gap between the discharging end t and the object D is locally stopped by a conductor or if they are caused into contact with each other, the discharge at the other portions is insured. The resistance of the resistor R is selectable over a wide range as shown in FIGS. 4A and 4B. However, excessively low resistances would cause a spark discharge to occur between the resistor R and the object D while excessively high resistances would prevent a sufficient discharge current from being attained. Hence, the resistance has to be selected on the basis of the voltage which can be applied, discharge current, characteristics of the object, etc. A copier, laser printer or similar recording apparatus using an electrophotographic procedure needs a discharge current of about 1 μA/cm to 10 μA/cm. In this repeat, a resistor R whose resistance ranges from $10^6$ Ω·cm to $10^{11}$ Ω·cm will be easy to use. While such a resistance is achievable by so selecting the specific resistance of the resistor R itself, it may of course be implemented by suitably selecting the distance between the conductive connector C and the discharging end or the cross-sectional area thereof.

The power source for applying a voltage to the discharging member of the present invention may have any suitable waveform. As FIGS. 4A and 4B indicate, a voltage lower than 5 kV, for example, suffices the discharge when positive or negative DC discharge is to be effected. Even a voltage as low as 1 kV to 3 kV will be sufficient if the resistance of the resistor R and the discharging gap are adequately selected. Further, the DC power source may be replaced with an AC power source having a sinusoidal or similar wave or with a current produced by superposing DC on such AC. Such a current promotes the control over the discharge of a delicate DC component, allows the gap between the discharging member and the object to be increased as needed, and insures stable discharge against the contamination of the discharging member due to aging or unexpected contamination.

Now, various embodiments of the present invention derived from the above principle will be described with reference to the figures. In the figures, the same components and structural elements are designated by like reference numerals, and redundant description will be avoided for simplicity.

The first embodiment of the present invention shown in FIG. 2 and outlined above in relation to the subject matter of the present invention will be described in detail. As shown, the resistor R has a flat plate-like configuration and faces at its discharging end t the object D which is mounted on the conductive table T. The charge from the power source P is propagated through the electrically interconnected conductive body C and resistor R to reach the object D as ions. To set up the electrical connection of the connector C and resistor R, the connector C may be implemented as an elastic plate of aluminum, copper or similar metal or a molding and may be configured to hold the resistor R. When it is desired to connect the connector C and resistor R electrically and mechanically at the same time, use may be made of a conductive adhesive or an interengageable projection and recess scheme. Alternatively, such simultaneous connection may be achieved by printing and sintering a conductive paste on the resistor R or by applying and drying a conductive solution on the same. Another possible scheme is to so configure one of the connector C and resistor R as to hold the other and to fix them together by grommets or small screws.

Figure 2:
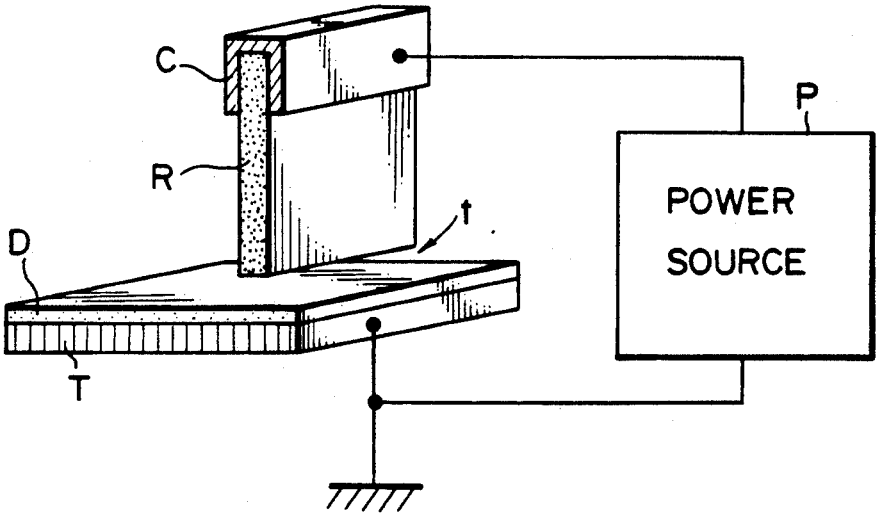
FIG. 2 is a view showing a charging device embodying the present invention.
Figure 3:
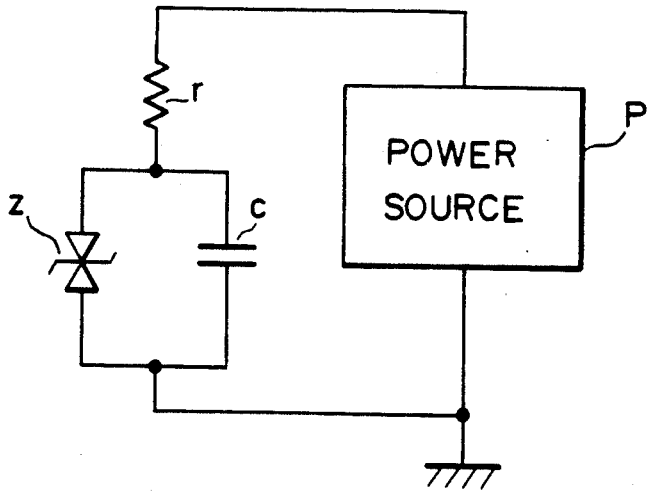
FIG. 3 is a diagram showing an equivalent circuit representative of the charging device shown in FIG. 2.
Figure 5A:
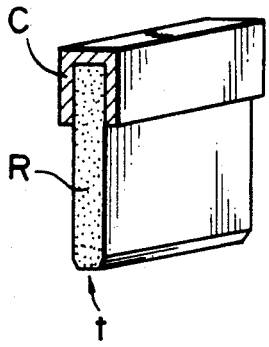
FIGS. 5A, 5B, 5C and 5D are views showing alternative embodiments of the present invention.
Figure 5B:
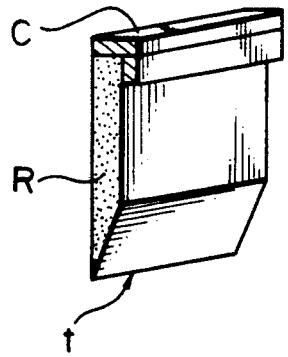
Figure 5C:
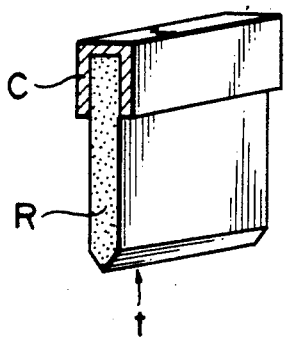
Figure 5D:
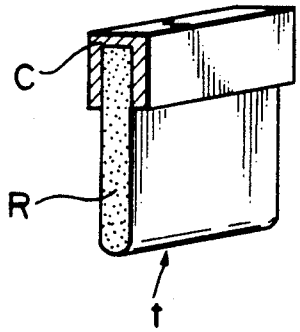

In FIG. 2, the discharging end t of the resistor R is provided with a rectangular surface like a cut end of a plate. Alternatively, the discharging end t may be notched at its corners, as shown in FIG. 5A, or one side thereof may be shaved off to have a sharp edge similar to a knife edge, as shown in FIG. 5B. Such an alternative configuration will render the electric field distribution around the discharging end t non-uniform and will thereby cause a relatively low voltage to start a discharge. Further, the discharging end t may be shaved off at opposite sides thereof and thereby sharpened, as shown in FIG. 5C, or rounded to have a semicircular cross-section, as shown in FIG. 5D. In this manner, the discharging end t may be configured as desired. While the resistor R is shown as extending perpendicular to the object D in FIG. 2, it may be inclined relative to the latter, in which case the edge of the resistor R close to the object D will play the role of the discharging end t.

The discharging member constituted by the resistor R and conductive connector C has an extremely simple structure, as shown and described. In addition, since the discharging member is easy to miniaturize and, therefore, occupies a minimum of space, a plurality of such discharging members may be arranged side by side to reduce the discharge current per discharging member. This will not only increase the durability but also enhance a uniform discharge. However, the charge from the power source flows not only through the inside of the resistor R as stated above but also along the surface of the resistor R. The current flowing along the surface of the resistor R is susceptible to the surface resistance of the resistor R which is in turn susceptible to moisture in the atmosphere as well as to contamination.

Figure 6:
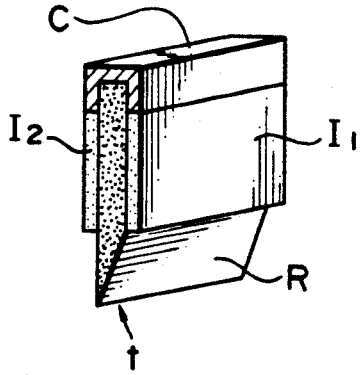
FIG. 6 is a perspective view of another embodiment of the discharging member of the present invention in which opposite sides of a resistor are provided with protective coverings.

FIG. 6 shows an alternative embodiment of the present invention provided with a countermeasure against the variation in the surface resistance of the resistor R. Specifically, the resistor R such as shown in FIG. 5B has opposite sides thereof covered with protective coverings $I_1$ and $I_2$. The coverings $I_1$ and $I_2$ may each comprise a soluble plastic material which is applied to and dried on the resistor R, or an insulative film fitted on the the resistor R by an insulative adhesive.

Figure 7A:
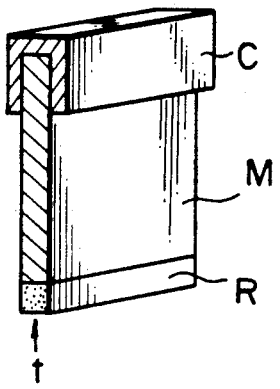
FIGS. 7A, 7B, 7C, 7D and 7E are perspective views showing alternative configurations of another embodiment of the discharging member of the present invention in which a conductive member M is provided intervening between a conductive connector C and a resistor R.
Figure 7B:
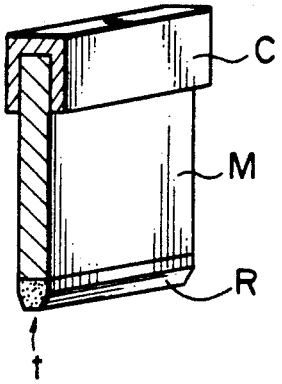
Figure 7C:
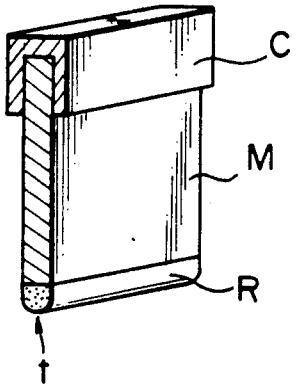
Figure 7D:
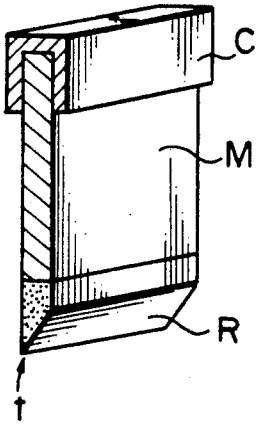
Figure 7E:
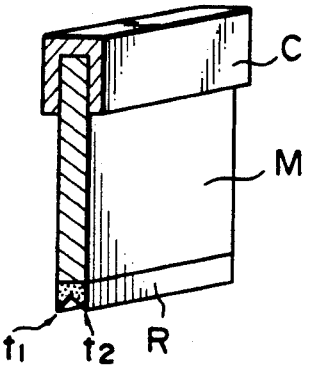

In the embodiments shown in FIGS. 2, 5A to 5D and 6, the resistor R and conductive connector C are constructed into an electrically interconnected unitary member. FIGS. 7A to 7E show an alternative configuration in which a conductive member M intervenes between the conductive connector C and the resistor R which serves as the discharging end t. Specifically, FIG. 7A shows the resistor R having a rectangular cross-section and mounted on that end of the conductive member M which faces the object D. The resistor R shown in FIG. 7A is preferably 2 mm thick or less. Thicker resistors R would render the discharging point and, therefore, the discharge itself irregular; thicknesses greater than 5 mm, for example, would make the discharge unstable. In the light of this, the discharging member may be inclined relative to the object D as stated earlier, so that one edge of the former may play the role of the discharging end t. Alternatively, as shown in FIG. 7B, the corners of the resistor R may be notched to reduce the effective thickness of the discharging end t. The resistor R may have a semicylindrical configuration, as shown in FIG. 7C. The resistor R of FIG. 7C has the discharging end t at its portion closest to the object D, whereby uniformity is easy to achieve in the lengthwise direction of the discharging member. In FIG. 7D, the resistor R is shaved off at one side thereof to form an edge-like discharging end t. In FIG. 7E, a V-shaped channel is formed in that end of the resistor R which faces the object D in order to form two parallel discharging ends $t_1$ and $t_2$. In any of the configurations shown in FIGS. 7D and 7E, the sharp edge or edges of the registor R serve as the discharging end t and thereby lower the discharge start voltage.

Figure 8A:
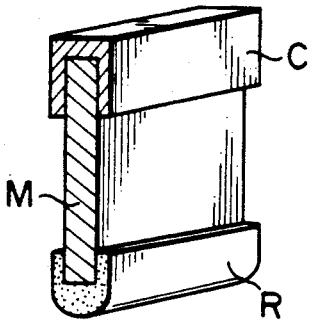
FIG. 8A is a perspective view and FIGS. 8B and 8C are side views of the discharging member of the present invention utilizing a resistor and conductive member implemented as separate members in which the resistor is formed with a recess in which the conductive member is tightly fitted (FIG. 8A), a conductive member is provided with a projection while the resistor R is provided with a complementary mating recess mating (FIG. 8B) or conversely the conductive member and resistor are provided with a recess and a mating projection, respectively (FIG. 8C)
Figure 8B:
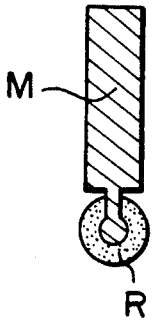
Figure 8C:
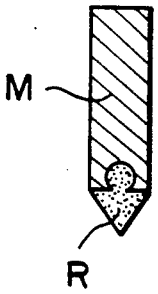

So long as the resistor has a substantial resistance, the resistor R and the conductive member M may be implemented as separate members and connected together by use of a conductive adhesive, by an interengageable projection and recess scheme, or by use of grommets or small screws, as stated previously. Specifically, FIG. 8A shows an alternative embodiment wherein the resistor R is formed with a recess in which the conductive member M is tightly fitted. In FIG. 8B, the conductive member M is provided with a substantially cylindrical projection, while the resistor R is provided with a recess complementary in shape to the projection and mating with the latter. Conversely, the conductive member M and the resistor R may be provided with a recess and a projection, respectively, as shown in FIG. 8C. In FIG. 8C, the resistor R is pointed to form a sharp discharging end t.

FIGS. 9A to 9E show alternative embodiments of the present invention in which the resistor R surrounds the entire periphery of the conductive member M that is connected to the power source. Specifically, in FIG. 9A, the resistor R is implemented as a hollow cylinder, and the conductive member M having a generally circular cross-section is coaxially received in the resistor.

Figure 9A:
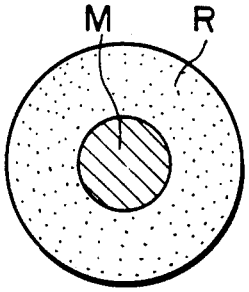
FIGS. 9A, 9B, 9C, 9D and 9E are cross-sectional views showing alternative embodiments of a discharging member according to the present invention in which a resistor surrounds the entire periphery of a conductive member.
Figure 9B:
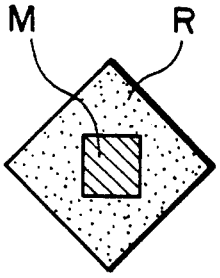
Figure 9C:
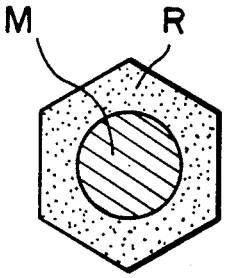

The resistor R shown in FIG. 9A defines the discharging end t at a portion thereof which is closest to the object D. In this case, a discharge is dependent on the resistance of the resistor R, curvature of the discharging end t, and power source voltage. Excessively low resistances of the resistor R would cause local discharge breakdown between the resistor R and the object D, while excessively high resistances would make it difficult to achieve the necessary discharge current and would thereby invite an increase in voltage. For an electrophotographic recording apparatus, therefore, resistances ranging from $10^6$ Ω·cm to $10^{11}$ Ω·cm are easy to use. While the discharge start voltage lowers as the curvature of the discharging end t becomes greater and the radius of the same becomes smaller, a diameter of 2 mm to 10 mm is preferable because a decrease in diameter translates into a decrease in the mechanical strength of the discharging member and, therefore, brings about a problem of bending. In FIG. 9B, both the conductive member M and the resistor R are provided with a square cross-section to provide the discharging member with four ridges. In FIG. 9C, the resistor R is provided with a hexagonal cross-section to provide the discharging member with six ridges. The discharging members shown in FIGS. 9B and 9C may be oriented such that any one of their ridges defines the discharging end t that faces the object D.

Figure 9D:
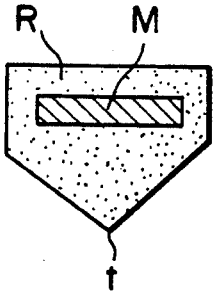
Figure 9E:
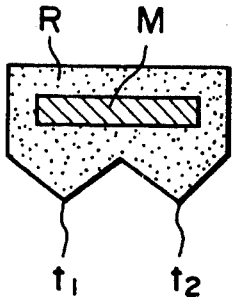

FIGS. 9D and 9E show other possible configurations of the discharging member in each of which the resistor R has a polygonal cross-section and surrounds the conductive member M. Specifically, in FIG. 9D, the resistor has a pentagonal cross-section to define a single linear discharging end t, i.e., the lowermost apex of the pentagon as viewed in the figure serves as the discharging end t that faces the object D. In FIG. 9E, the resistor R has a cross-section in which two pentagons are joined together side by side, so that the apexes $t_1$ and $t_2$ of the two pentagons define two discharging ends t. The multi-ridge resistor configuration shown and described is advantageous in that when one of the edges serving as the discharging end is deteriorated due to aging to render a discharge unstable, the discharging member may be rotated to use another ridge just as if it were replaced with a fresh discharging member. This is successful in increasing the service life of the discharging member to a noticeable degree.

Figure 10A:
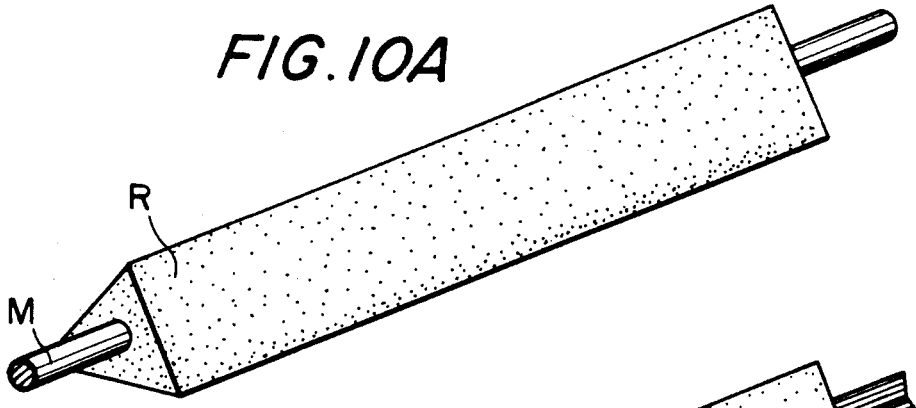
FIGS. 10A, 10B, 10C and 10D are perspective views of additional variations of discharging members of the present invention in which a resistor is surrounded by a conductive member.
Figure 10B:
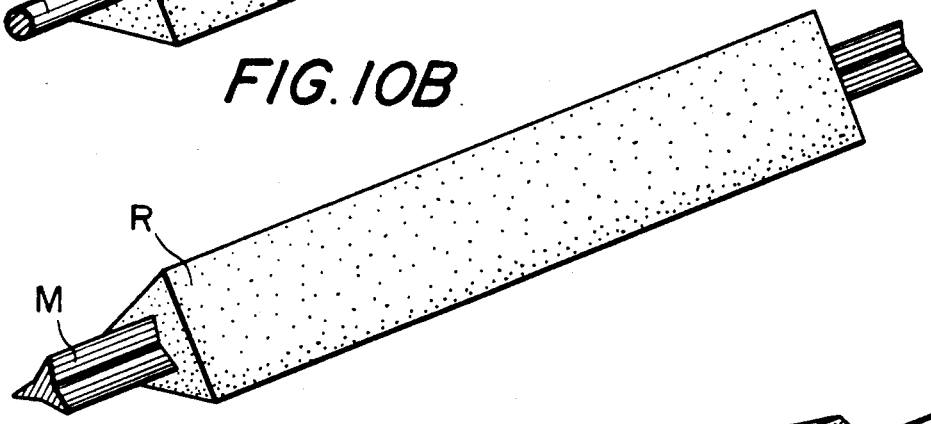
Figure 10C:
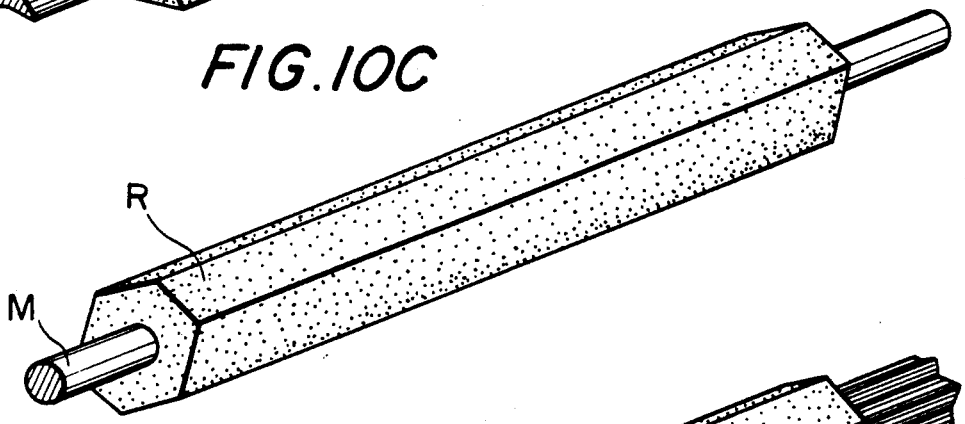
Figure 10D:
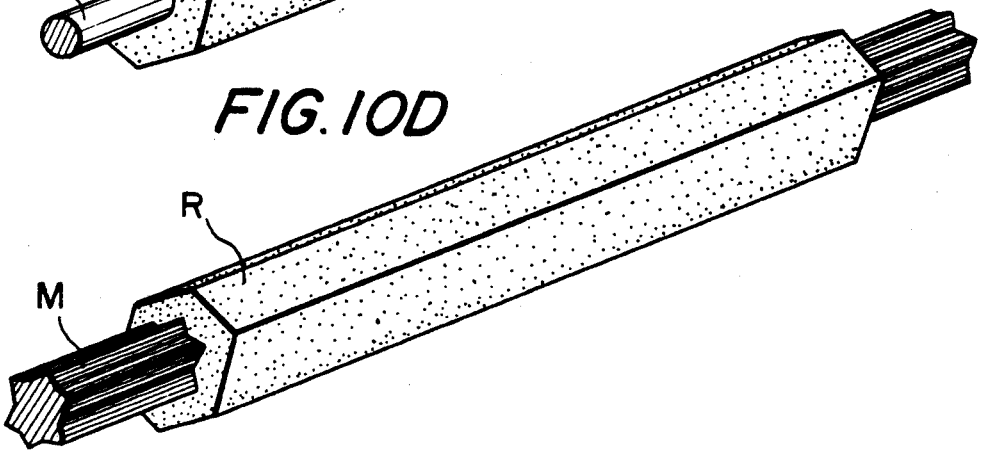

FIGS. 10A to 10D show modified forms of the embodiments described above with reference to FIGS. 9A to 9E. Specifically, in FIG. 10A, the resistor R has a triangular cross-section and accommodates at its center the conductive member M having a circular cross-section. In FIG. 10B, the conductive member M extending throughout the resistor R has a generally triangular star-like cross-section and has three ridges thereof aligning with those of the resistor R. In FIGS. 10C and 10D, the resistor R has a hexagonal cross-section. The conductive member shown in FIG. 10D differs from the conductive member of FIG. 10C in that it has a generally hexagonal star-like cross-section and has six ridges thereof aligning with those of the resistor R.

The discharging members shown in FIGS. 9A to 9E and 10A to 10D sufficiently discharge even when the surface resistance of the resistor R is lowered due to dew condensation or similar cause. The configurations shown in FIGS. 10B and 10D, in particular, has an advantage that a current from the conductive element M readily concentrates on the ridges of the resistor R via the ridges of the conductive element M, further reducing the influence of the dew condensation or contamination which may occur the surface of the resistor R.

Figure 11:
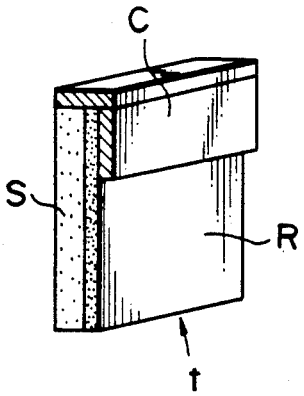
FIG. 11 is a perspective view showing an alternative embodiment of the discharging member of the present invention in which a flat resistor is formed on the surface of an insulating substrate provided with a conductive connector.
Figure 12:
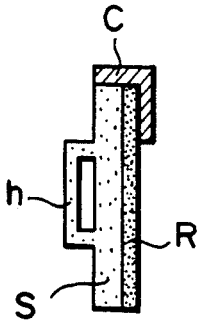
FIG. 12 is a side view of a modification of the discharging member shown in FIG. 11 in which the substrate is provided with a handle.

FIG. 11 shows an alternative embodiment of the present invention in which the resistor R is provided in the form of a flat layer on the surface of a substrate S which is made of glass, plastic, ceramic or similar insulating material. The charge from the conductive connector C is propagated through the resistor R to reach the discharging end t and then emitted as ions toward the object D. This kind of configuration allows the discharging end t to have uniformity with ease, broadens the selectable range of configurations and materials due to the discrete substrate S and resistor R, and reduces the required amount of material constituting the resistor R and, therefore, the cost. As shown in FIG. 12, the substrate S may be provided with a handle h to promote easy handling and maintenance of the discharging member.

Figure 13:
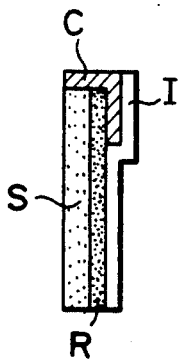
FIG. 13 is a side view of a modification of the discharging member shown in FIG. 11 in which an insulating layer is provided as a protective coating over the resistor.

The discharging member shown in FIG. 11, like the discharging member of FIG. 6, may be provided with a protective covering I, as shown in FIG. 13. Specifically, as shown in FIG. 13, a covering I is provided on the resistor R for the purpose of preventing the surface resistance of the resistor R from being effected by moisture and contamination. Again, the covering I may be implemented by a soluble plastic material which is applied and dried on the resistor R or an insulative film adhered to the resistor by an insulative adhesive. In this particular embodiment, the covering I is extended to the conductive connector C so as to prevent moisture and contaminants from entering the discharging member via the interface between the connector C and the resistor R.

Figure 14A:
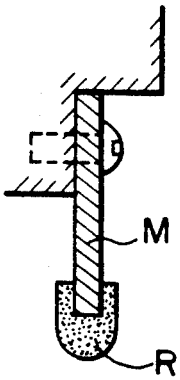
FIGS. 14A, 14B and 14C are cross-sectional views illustrating fastening of the discharging member of the present invention to horizontal and vertical walls of an apparatus body.
Figure 14B:
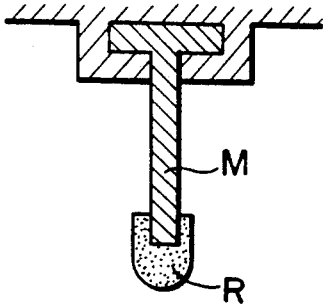
Figure 14C:
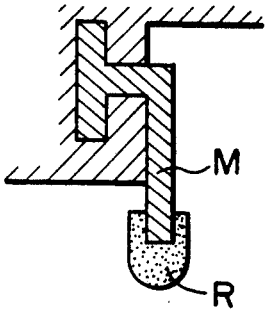

The discharging member having the conductive member M between the conductive connector C and the resistor R as shown in FIG. 8A may be mounted on the body of a copier or similar apparatus in any of specific configurations shown in FIGS. 14A to 14C. In FIG. 14A, the flat conductive member M is fastened to the apparatus body by a screw. In FIG. 14B, the conductive member M having a T-shaped cross-section is mounted on a horizontal wall of the apparatus body. In FIG. 14C, the conductive member M is provided with a modified cross-section so as to be mounted on a vertical wall of the apparatus body.

Figure 15A:
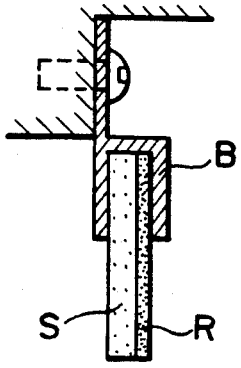
FIGS. 15A, 15B and 15C are cross-sectional views illustrating additional configurations for fastening the discharging member of the present invention implemented by means of a resistor layer formed on the surface of an insulative substrate to different surfaces of an apparatus body.
Figure 15B:
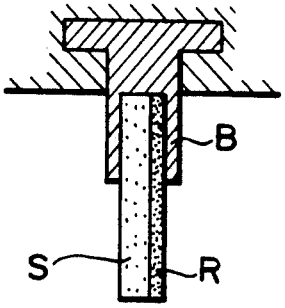
Figure 15C:
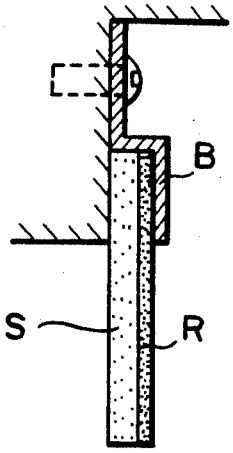

FIGS. 15A to 15C show specific configurations for mounting on the apparatus body the discharging member which has the resistor layer R on the surface of the insulative substrate S as shown in FIG. 11. In FIG. 15A, a support member B serving as a conductive connector retains the discharging member and is fastened to the apparatus body by a screw. In FIG. 15B, the support member B retains the discharging member and is engaged with the apparatus body. In FIG. 15C, the support member B is implemented as a metal fixture and fastened to the apparatus body by a screw to hold the discharging member.

In any of the configurations shown in FIGS. 14A to 14C and 15A to 15C, it is of course necessary that the discharging member be mounted on an insulative part of the apparatus or mounted on the apparatus body with the intermediary of an insulative base, because a high voltage is applied to the conductive member M or the support member B.

Assume that the object D is in the form of a plate or a belt. Then, the gap between the discharging end t and the object D is apt to change when the object D is in movement or subjected to externally derived vibration. In the case that the object D is implemented as a rotatable body, the gap is apt to change due to the offset of a shaft on which the rotatable body is mounted. Such a change in the gap would change the field intensity in the gap and thereby the charge potential on the object D. This problem has customarily been solved by sensing the discharge current at a power source and, when the current has changed, changing the voltage to maintain the discharge current constant. When the discharging member with the resistor R in accordance with the present invention is used, the gap of interest can be made far smaller than the prior art, e.g., several tens of microns to several millimeters and, therefore, it changes by a substantial ratio. In this condition, relying on the constant current scheme as mentioned above would require the voltage from the power source to be variable over an extremely broad range, resulting in the need for a complicated and expensive power source arrangement.

Figure 16A:
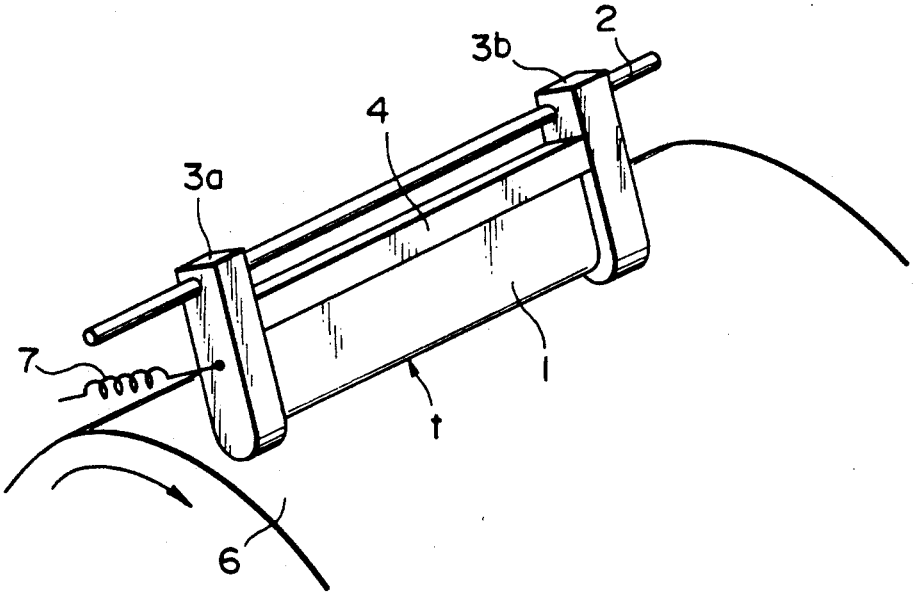
FIGS. 16A and 16B are perspective and side views showing an alternative embodiment of the present invention in which a discharging gap between a discharging end of a discharge member of the invention and an object is maintained constant.
Figure 16B:
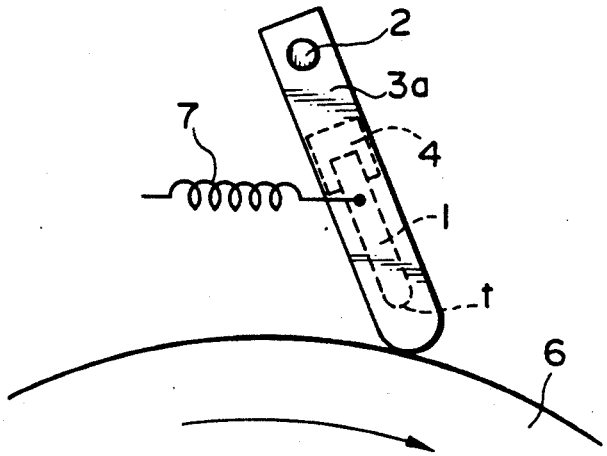

FIGS. 16A and 16B show an alternative embodiment of the present invention provided with an arrangement for maintaining the gap between the discharging end t and the object D constant. In the figures, the object D is implemented as a drum 6. A resistor 1 is a generally flat resistor and corresponds to the resistor R of any one of the previously stated discharging members. A pair of arms 3*a* and 3*b* are rotatably mounted on an unmovable shaft 2 and made of an insulative material such as a plastic or a ceramic. The resistor 1 is supported by the rotatable arms 3*a* and 3*b*. A conductive connector 4 is connected to a power source and conductively connected to the upper edge of the resistor 1 which is close to the shaft 2. The lower edge of the resistor 1 constitutes the discharging end t that faces the drum or object 6. As shown in FIG. 16B, the arms 3*a* and 3*b* are constantly biased by a spring 7 to hold their tips in contact with the drum 6 which is rotating as indicated by an arrow in the figure. In this configuration, the gap between the discharging end t of the resistor 1 and the drum 6 is maintained constant.

Figure 17:
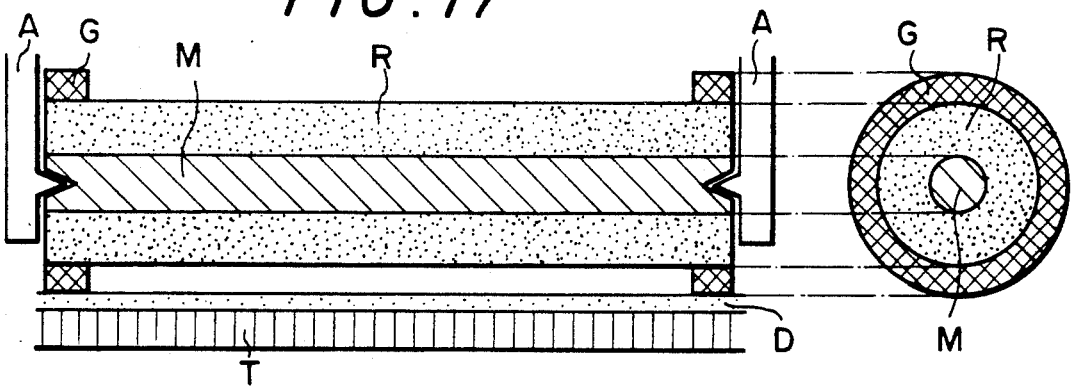
FIG. 17 is a side view illustrating an alternative embodiment for maintaining constant a discharge gap between a discharging member of the present invention and an object.

FIG. 17 depicts an alternative implementation for maintaining the discharge gap constant. A section along a dash-and-dots line is shown at the right-hand side of the figure. This particular embodiment uses the discharging member having the conductive member M made of metal and the resistor R which surrounds the conductive member M, as shown in FIG. 9A. The conductive member M has recesses at opposite sides of its axis. Arms A extending from the apparatus body has lugs which are individually mated with the recesses of the conductive member M. The arms A, therefore, rotatably support the conductive member M and resistor R. Flanges G made of a plastic or similar insulative material are fitted on opposite ends of the resistor R, while the object is laid on the conductive table T which is connected to ground. A discharge gap corresponding to the thickness of the flanges G is defined between the resistor R and the object D and maintained constant even if the axis of rotation of the discharging member is offset, for example.

Figure 18A:
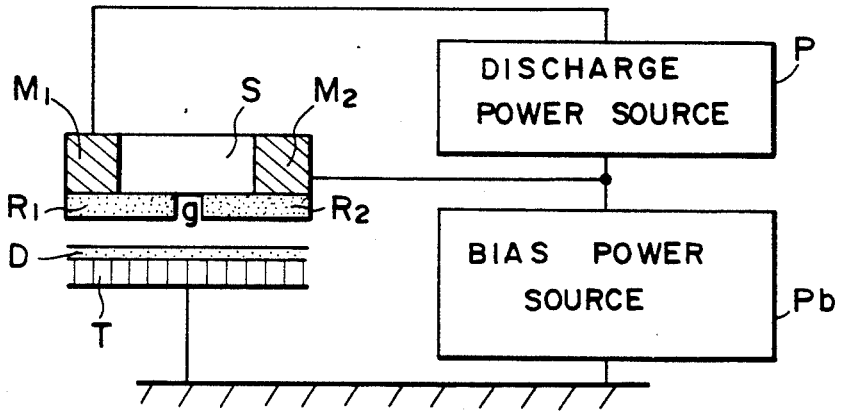
FIGS. 18A, 18B, 19, 20A and 20B are schematic circuit diagrams illustrating application of a discharging member of the present invention provided with a gap in the resistor thereof.
Figure 18B:
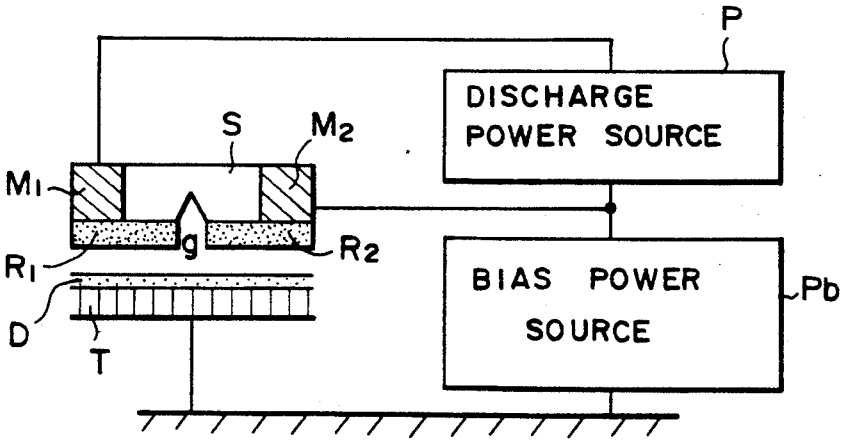

Referring to FIGS. 18A and 18B, alternative embodiments of the present invention are shown in which resistors $R_1$ and $R_2$ each being several tens of microns to several millimeters thick are mounted on a substrate S and spaced apart from each other by a gap g. The resistor $R_1$ is connected to one terminal of a discharge power source P via a conductive member $M_1$ adapted for conductive connection, while the resistor $R_2$ is connected to the other terminal of the power source P via a conductive member $M_2$. A discharge occurring in the gap g causes ions to charge the object D. The discharge power source P corresponds to the power source previously stated, but it will be so termed in distinction from a bias power source Pb which will be described. It is not necessary that the resistors $R_1$ and $R_2$ serving as discharging elements have the same resistance. Since the discharge gap g is not located between the discharging end and the object, it can be reduced to lower the discharge start voltage and, hence, low voltage drive is implemented. This not only simplifies the discharge power source but also makes it possible to increase the distance between the discharging member and the object even to several millimeters.

The bias power source Pb increases the discharging efficiency by directing the ions generated by a corona discharge effectively toward the object D. Specifically, the voltage from the bias power source Pb is applied across the conductive table T on which the object D is loaded and one $R_2$ of the resistors, whereby ions associated with the polarity of the power source Pb migrate toward the object D to charge it efficiently. However, the bias power source Pb is not essential. When the power source Pb is omitted, the junction of the discharge power source P and conductive member $M_2$ will be directly connected to ground. The voltages of the discharge power source P and bias power source Pb may be either one of AC and DC or even be DC-superposed AC. While discharge occurs among the resistors $R_1$ and $R_2$ and object D, the distribution of the resulting discharge currents is dependent on the dimensions of the gaps, the polarities and values of the voltages, and the resistance of the resistor R. If the discharge power source P and bias power source Pb are implemented by DC voltages, it is possible to increase the distance between the discharging member and the object. When the bias power source uses an AC voltage, the AC voltage can be delicately controlled to increase the margin concerning the distance between the discharging member and the object. Preferably, as shown in FIG. 18B, the surface of the substrate S is notched or otherwise recessed over the gap g. This is because the portion of the surface of the substrate S extending along the gap g is apt to cause the leakage of charge and to thereby render the discharge unstable.

Figure 19:
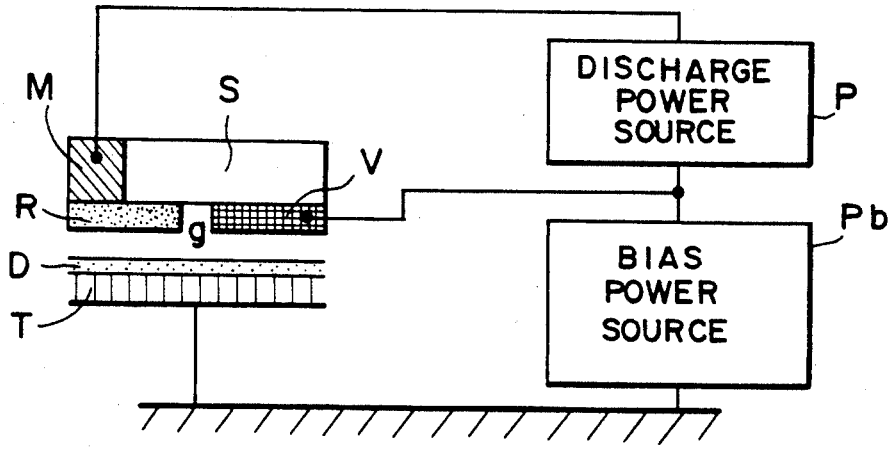

FIG. 19 shows an alternative embodiment of the present invention having the resistor R and a conductor V which replaces one of the resistors shown in FIGS. 18A and 18B. Specifically, the resistor R which is several microns to several millimeters thick and the conductor V are mounted on the substrate S and spaced apart from each other by a gap g which is the discharge gap. The resistor R is connected to one terminal of the discharge power source P via the conductive member M, while the conductor V is connected to the other terminal of the power source P. The discharging member shown in FIG. 19 operates in essentially the same manner as the discharging member of FIGS. 18A and 18B.

Figure 20A:
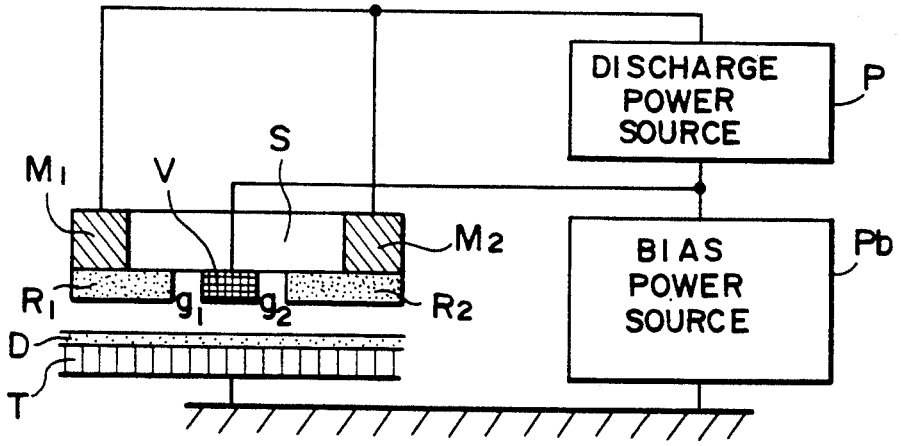
Figure 20B:
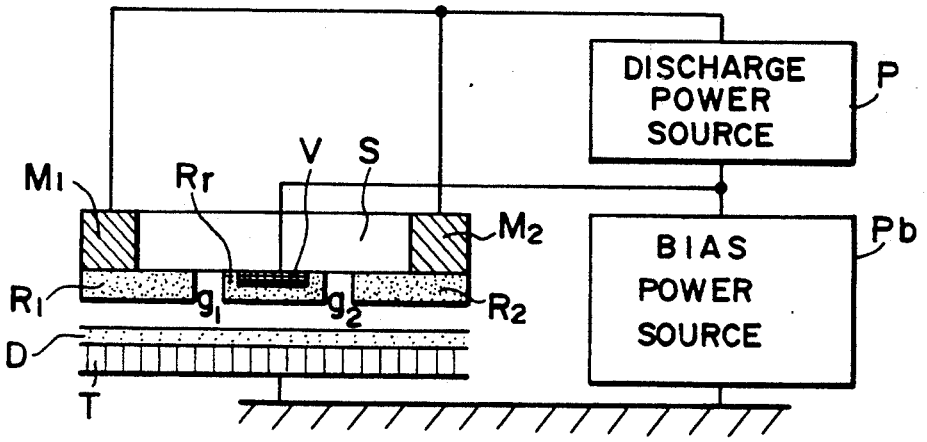

FIGS. 20A and 20B each shows an alternative embodiment of the present invention in which the conductor V is mounted on one major surface of the substrate S with gaps $g_1$ and $g_2$ being defined between the conductor V and the resistors $R_1$ and $R_2$, respectively. The resistors $R_1$ and $R_2$ are connected to one terminal of the discharge power source P via conductive members $M_1$ and $M_2$, respectively. The conductor V is connected to the other terminal of the discharge power source P. In this particular embodiment, the resistors $R_1$ and $R_2$ and the conductor V play the role of discharging elements. The embodiment of FIG. 20B differs from the embodiment of FIG. 20A in that the conductor V is covered with a resistor Rr. The voltage from the discharge power source P is applied across the resistors $R_1$ and $R_2$ and the conductor V, so that corona discharge occurs in the gaps $g_1$ and $g_2$, i.e., between the discharging ends of the resistors $R_1$ and $R_2$ and the opposite ends of the conductor V. On the other hand, the voltage from the bias power source Pb is applied across the conductive table T loaded with the object D and the conductor V. Hence, ions associated with the polarity of the power source Pb propagate toward the object D to charge it. Again, the bias power source Pb is not essential and, when it is omitted, the conductor V and one terminal of the discharge power source P which is connected to the conductor V will be directly connected to ground.

Figure 21:
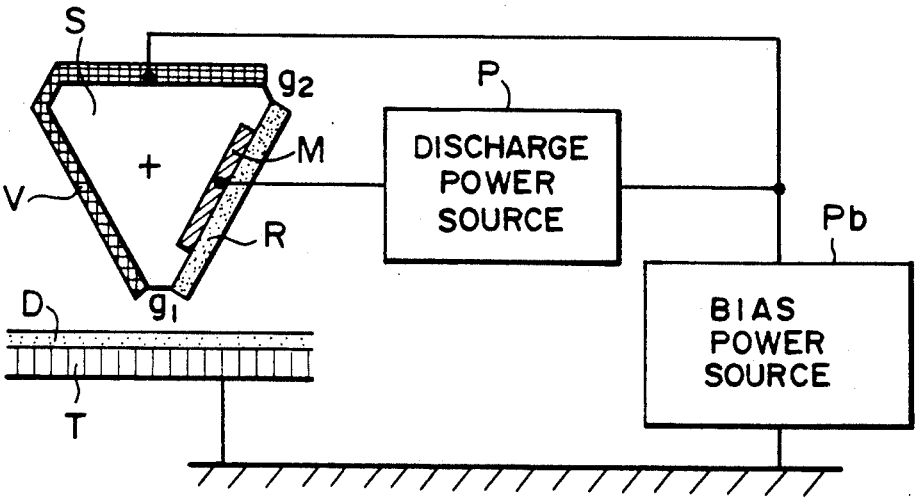
FIG. 21 is a schematic circuit diagram illustrating application of a discharging member of the present invention having a triangular substrate with a resistor mounted on one side of the triangular substrate and conductors mounted on the other sides thereof with discharge gaps at the corners between the resistor and the conductors.

FIG. 21 shows an alternative embodiment of the present invention in which the substrate S is provided with a generally triangular cross-section and loaded with the resistor R on one surface thereof and loaded with the conductor V on the other two contiguous surfaces. The resistor R and conductor V serve as discharging elements. The conductive member M is embedded in the surface portion of the substrate S for applying the discharge voltage to the resistor R. Discharge gaps $g_1$ and $g_2$ are defined between opposite ends of the resistor R and the adjoining ends of the conductor V, i.e., at the apexes of the triangular cross-section where the resistor R and conductor V neighbor each other. When the voltage from the discharge power source P is applied across the conductor V and resistor R, a corona discharge occurs in the discharge gaps $g_1$ and $g_2$ so that the resulting ions migrate toward the object D to charge it. In the condition shown in FIG. 21, ions from the discharge gap $g_1$ that neighbors the object D are effectively used to charge the object D. The discharging member, therefore, may be so arranged as to be rotatable to bring the other discharge gap $g_2$ to the charging position in place of the discharge gap $g_1$. Then, when the discharge gap $g_1$ is deteriorated due to aging, it can be replaced with the discharge gap $g_2$ to thereby increase the service life of the discharging member.

Figure 22:
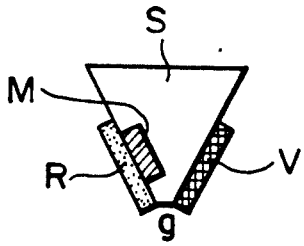
FIG. 22 is a side view partially in cross section of a modified form of the discharging member shown in FIG. 21.

FIG. 22 shows a modified form of the discharging member shown in FIG. 21. Specifically, when the replacement of one discharge gap with the other as shown and described is not needed, the substrate S may be loaded with the resistor R on one surface thereof and with the conductor V on another surface. The adjoining ends of the resistor R and conductor V define the discharge gap g therebetween.

Figure 23A:
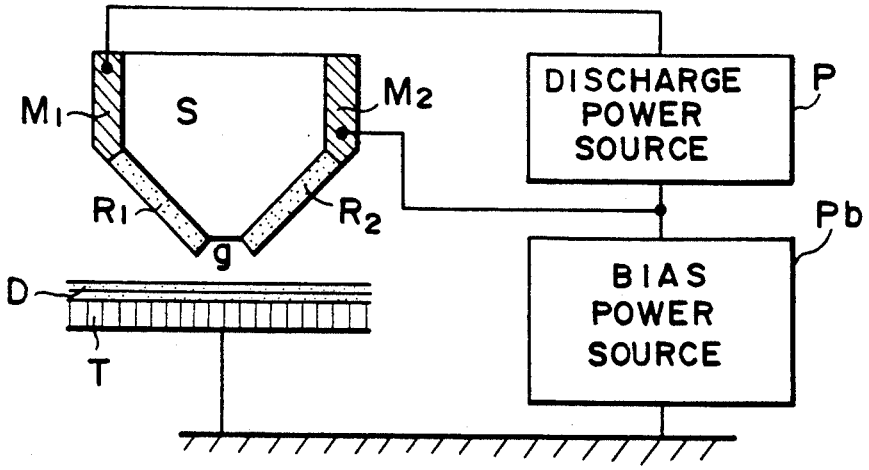
FIGS. 23A, 23B, 23C, 24, 25, and 26 are schematic circuit diagrams illustrating various embodiments of a discharging member of the present invention implemented by means of different multi-sided substrates having resistor portions and conductor portions formed on the different sides to produce discharge gaps.
Figure 23B:
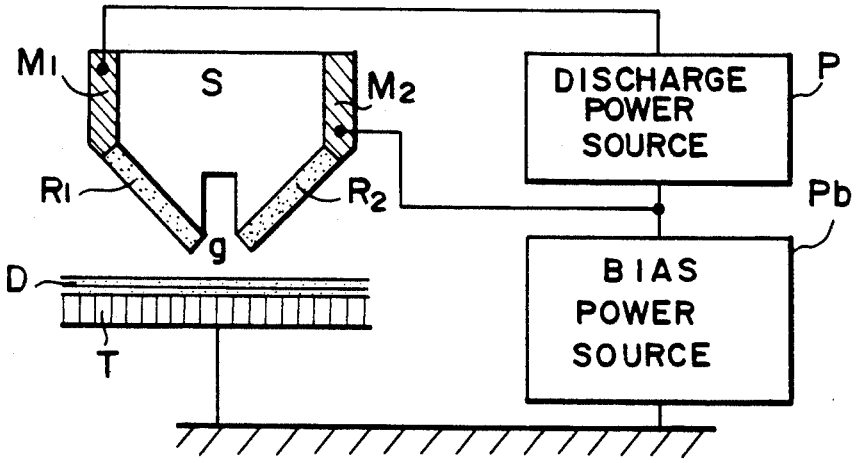
Figure 23C:
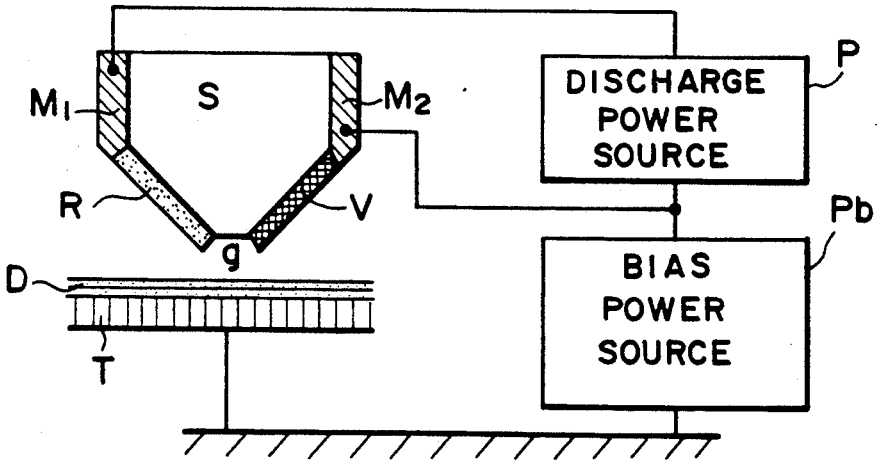

Referring to FIGS. 23A to 23C, alternative embodiments of the present invention are shown in each of which the substrate S has a generally pentagonal cross-section and a single discharge gap such as shown in FIG. 22 is defined. Specifically, the pentagonal cross-section has a first and a second side which face each other and a third and a fourth side which extend from the first and second sides, respectively, toward the apex of the pentagon. In all the embodiments shown in FIGS. 23A to 23C, the conductive members $M_1$ and $M_2$ are respectively mounted on the first and second sides of the substrate S. In FIGS. 23A and 23B, the resistors $R_1$ and $R_2$ are respectively mounted on the third and fourth sides of the substrate S. In FIG. 23C, the resistor R and the conductor V are mounted on the third and fourth sides, respectively. In the specific arrangement shown in FIG. 23B, the surface of the substrate S overlying the discharge gap g is recessed to eliminate the leakage of charge which would otherwise occur therealong, as discussed in relation to the embodiment of FIG. 18B.

Figure 24:
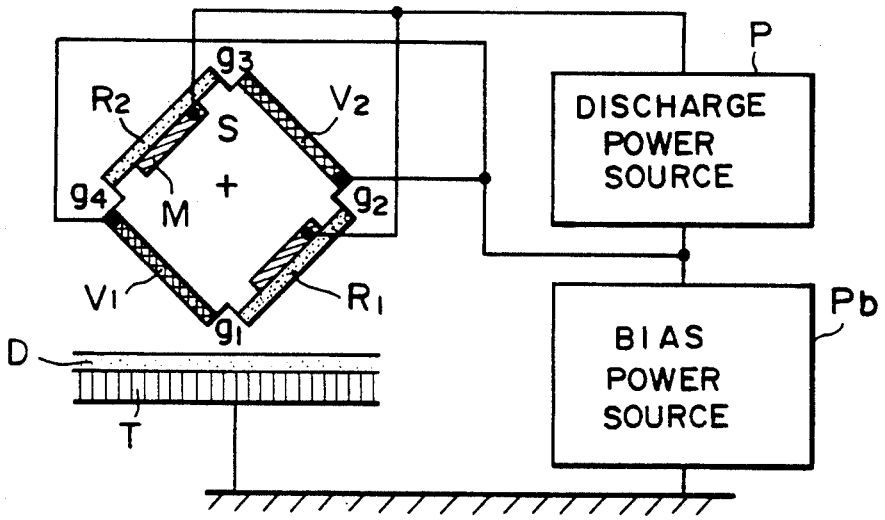

FIG. 24 shows an alternative embodiment of the present invention which is essentially similar to the embodiment of FIG. 21 except that the triangular cross-section of the substrate S is replaced with a generally square cross-section, and that the resistors $R_1$ and $R_2$ are mounted on two facing sides of the square while conductors $V_1$ and $V_2$ are mounted on the other two facing sides of the same. The discharging member having such a configuration is essentially the same as the discharging member of FIG. 21 concerning the operation. The discharging member of FIG. 24 has four discharge gaps $g_1$ to $g_4$ and, therefore, four times longer service life than the discharging member having a single discharge gap. Specifically, the discharging member may be rotated about the center of the substrate S to bring one of the four discharge gaps to a position where it faces the object D.

Figure 25:
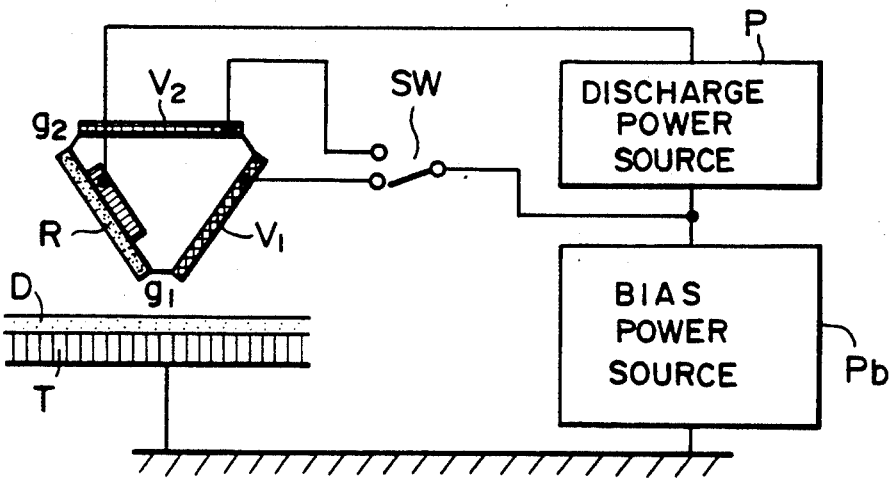
Figure 26:
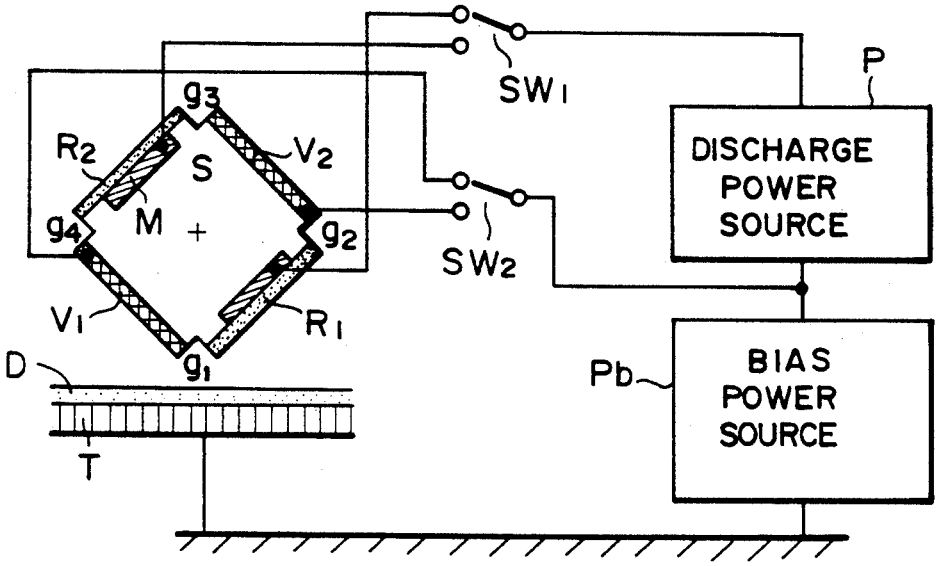

In the embodiments shown in FIGS. 21 and 24, ions generated in the discharge gaps $g_2$, $g_3$ and $g_4$ which are remote from the object D are not effectively used. FIGS. 25 and 26 show alternative embodiments which promote power saving by effecting discharge only in the discharge gap $g_1$ that is close to the object D. Specifically, these embodiments are constructed to apply the voltage from the discharge power source P only to the resistor and conductor which define the discharge gap $g_1$ therebetween. In FIG. 25, the contiguous conductor V provided on two sides of the generally triangular substrate as shown in FIG. 21 is divided into two discrete conductors $V_1$ and $V_2$. A switch SW is operable to connect only one $V_1$ of the conductors $V_1$ and $V_2$ that is close to the object D to the discharge power source P, so that a corona discharge may occur in the discharge gap $g_1$ only. In FIG. 26, switches $SW_1$ and $SW_2$ selectively connect the resistors $R_1$ and $R_2$ and the conductors $V_1$ and $V_2$, respectively, to the discharge power source P in order to effect a corona discharge in the discharge gap $g_1$ only.

Referring to FIGS. 27 to 31, there are shown alternative embodiments of the present invention each having a plurality of discharging ends which are arranged in parallel. This kind of configuration will insure uniform charging of the object D, compared to a single discharging end scheme.

Figure 27:
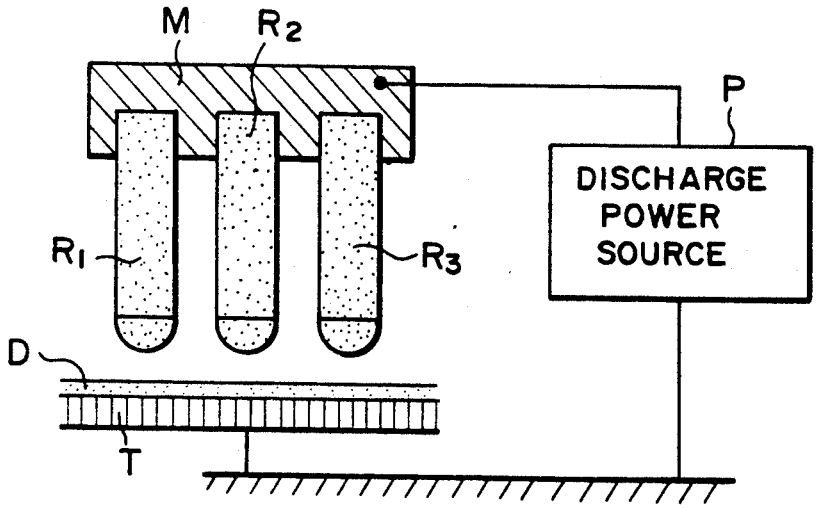
FIG. 27 is a schematic circuit diagram of a discharging member employing a plurality of flat resistors mounted integrally on a conductive member opposite an object to be charged.

Specifically, in FIG. 27, a plurality of flat resistors, three flat resistors $R_1$, $R_2$ and $R_3$ in the figure, are mounted integrally on the conductive member M which also plays the role of a holder. While each of the resistors $R_1$, $R_2$ and $R_3$ is shown as having a semicylindrical tip such as shown in FIG. 5D, it may of course be provided with any other suitable end structure or end configuration such as shown in any one of FIGS. 2 and 5A to 7E.

Figure 28:
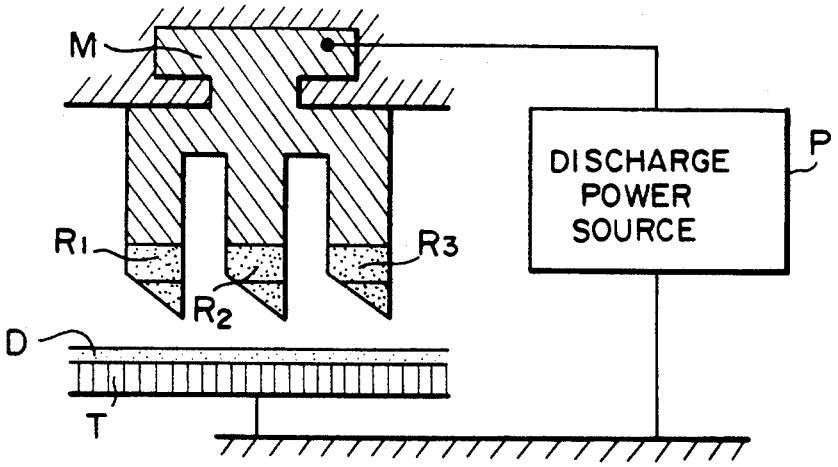
FIG. 28 is a schematic circuit diagram showing a modified form of a discharging member shown in any one of FIGS. 7A–7E in which a conductive connector and a conductive member are constructed into a single conductive member holding a plurality of resistors.

FIG. 28 shows a modified form of the discharging member shown in any one of FIGS. 7A to 7E which has the conductive connector C, conductive member M, and resistor R. Specifically, in FIG. 28, the conductive connector C and conductive member M are constructed into a single conductive member M which holds a plurality of resistors $R_1$, $R_2$ and $R_3$.

Figure 29A:
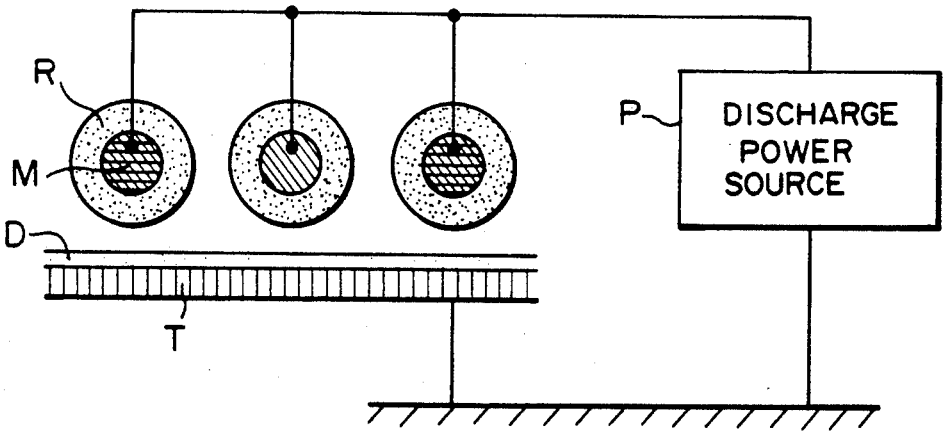
FIG. 29A is a schematic circuit diagram illustrating a plurality of rod-like discharging members arranged in parallel opposite an object to be charged.
Figure 29B:
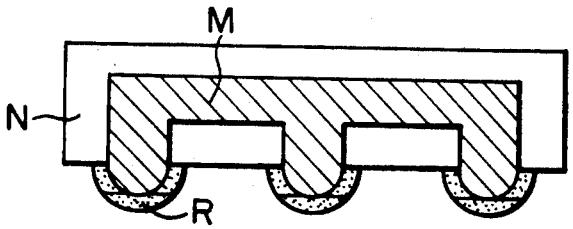
FIG. 29B is a cross-sectional view of a variation of the discharging member shown in FIG. 29.

In FIG. 29A, a plurality of rod-like discharging members are arranged in parallel, and each has the conductive member M and resistor R which are coaxial with each other. In FIG. 29B, the conductive member M has three parallel ridges and is embedded in an insulative member N. The resistor R is provided on those portions of the ridges which protrude from the insulative member N. The configurations shown in FIGS. 29A and 29B are immune to variations in ambient conditions because the surfaces of the conductive members are concealed.

Figure 30:
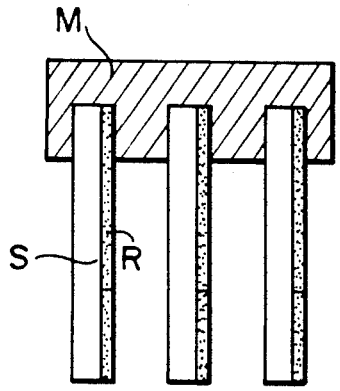
FIG. 30 is a side view illustrating a plurality of discharging members in the form of discharging member shown in FIG. 11 held in parallel by a conductive member.
Figure 31A:
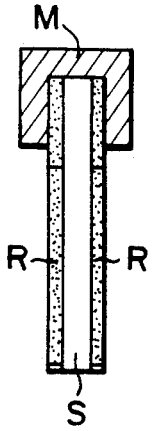
FIGS. 31A, 31B, 31C and 31D are side views of additional variations of a discharging member having resistors on opposite surfaces of a single substrate.
Figure 31B:
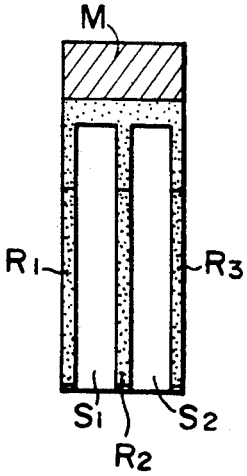
Figure 31C:
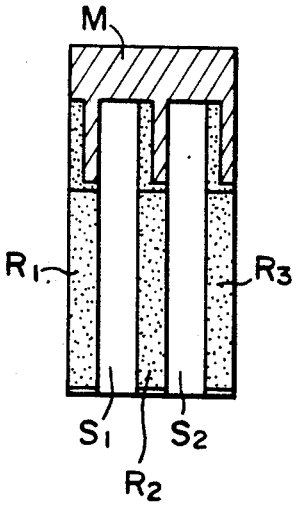
Figure 31D:
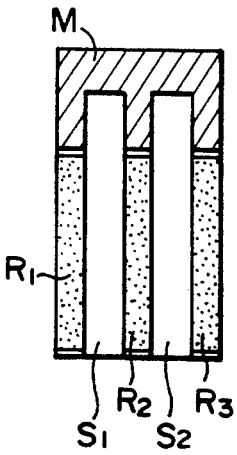

FIG. 30 shows a plurality of discharging members each being implemented as the discharging member of FIG. 11 which has the insulative substrate S and the resistor R. Specifically, the discharging members are held in parallel by the conductive member M. FIG. 31 shows a discharging member having a resistor on opposite surfaces of a single substrate S. FIGS. 31B to 31D each shows two substrates $S_1$ and $S_2$ on which are provided three resistors $R_1$, $R_2$ and $R_3$ total.

A copier, printer or similar apparatus is operable with paper sheets of various sizes. It is necessary, therefore, that such an apparatus be capable of charging paper sheets of the largest size usable therewith. This is undesirable, however, when paper sheets of relatively small sizes are used.

Figure 32A:
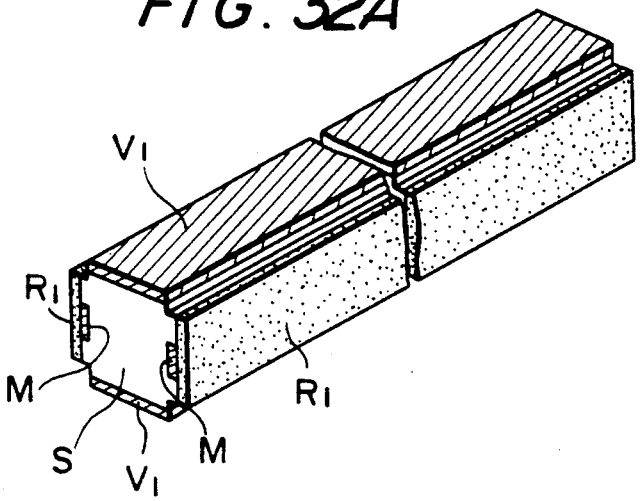
FIGS. 32A and 32B are perspective views illustrating the discharging member of FIG. 24.
Figure 32B:
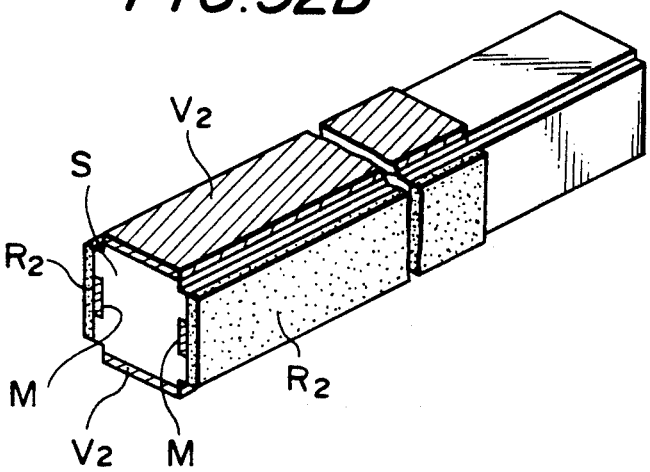

Specifically, FIGS. 32A and 32B show the discharging member of FIG. 24 in a perspective view. In FIG. 32A, the resistor $R_1$ and conductor $V_1$ are provided over the entire length of the insulative substrate S so as to effect charging over the width corresponding to their length. However, when the paper sheet has a relatively small width, ions are wastefully generated at the end of the discharging member. This not only renders the charge distribution non-uniform but also brings about the waste of power. As shown in FIG. 32B, the discharging member may be provided with the resistor $R_2$ and conductor $V_2$ each having a particular length matching the width of a paper sheet used in order to solve the above problem.

Figure 33:
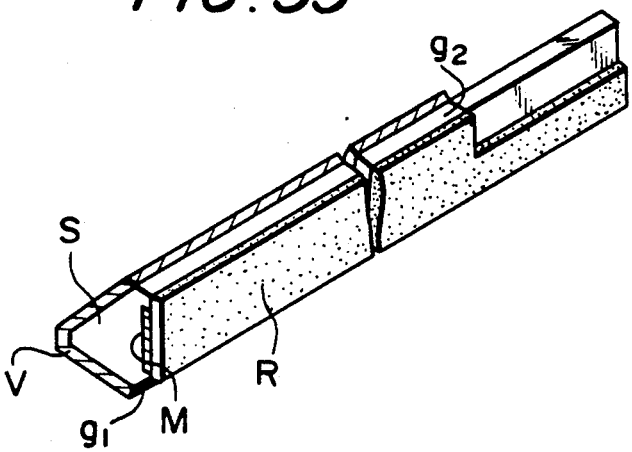
FIG. 33 is a perspective view of a discharging member similar to the embodiment of FIG. 21 but having discharge gaps differing in length from each other.

FIG. 33 shows an alternative embodiment of the present invention which is essentially similar to the embodiment of FIG. 21 except that the discharge gaps $g_1$ and $g_2$ differ in length from each other. Since the discharging member is rotatable, one of the longer discharge gap $g_1$ and shorter discharge gap $g_2$ can be used in matching relation to the size of paper sheets used.

Figure 34A:
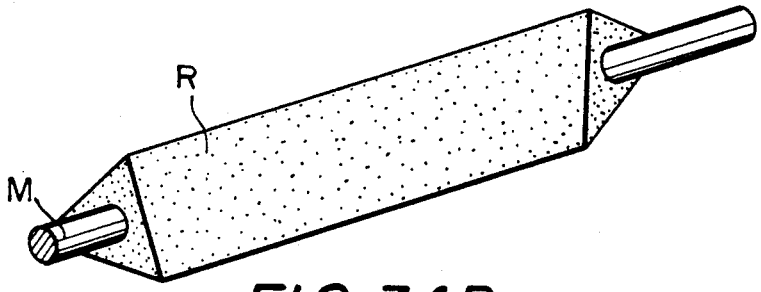
FIGS. 34A and 34B are respectively perspective and side elevational views of an alternative embodiment of the discharging member shown in FIG. 10A with the exception that the generally triangular resistor is provided with ridges having different lengths.
Figure 34B:
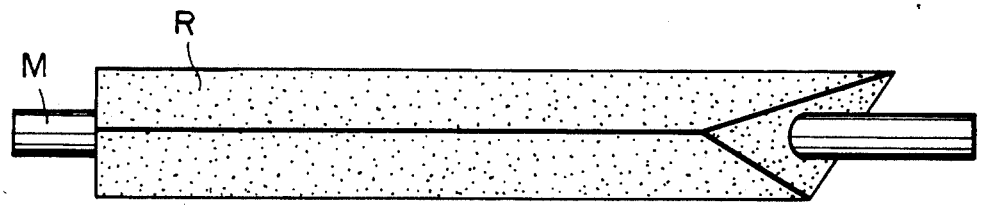
Figure 34C:
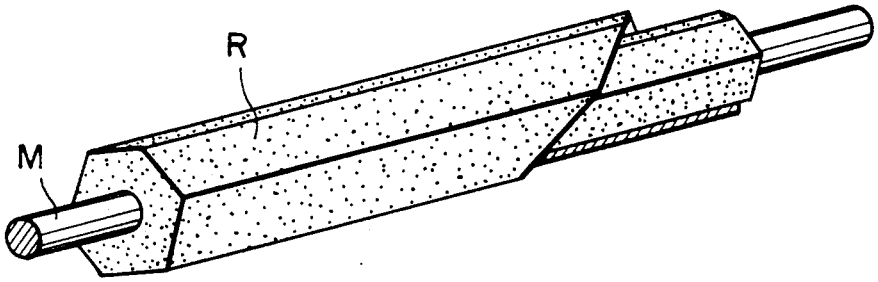
FIGS. 34C and 34D are respectively perspective and side elevational views illustrating an alternative embodiment of the discharging member of FIG. 10C in which ridges of a generally hexagonal resistor are provided with different lengths.
Figure 34D:
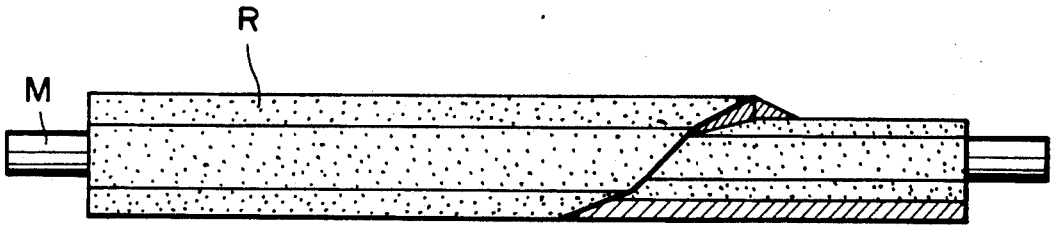

FIGS. 34A and 34B show in a perspective view and a side elevation, respectively, an alternative embodiment of the present invention which is similar to the configuration shown in FIG. 10A except that the generally triangular resistor R has ridges each having a different length. The discharging member is rotatable about the conductive member M to use the three ridges as a discharging end one at a time. FIGS. 34C and 34D show in a perspective view and a side elevation, respectively, an alternative embodiment of the present invention which uses the discharging member of FIG. 10C and provides each of the ridges of the generally hexagonal resistor R with a different length. Such a discharging member may be rotated by each 60 degrees to selectively set up six different charging widths.

Figure 35C:
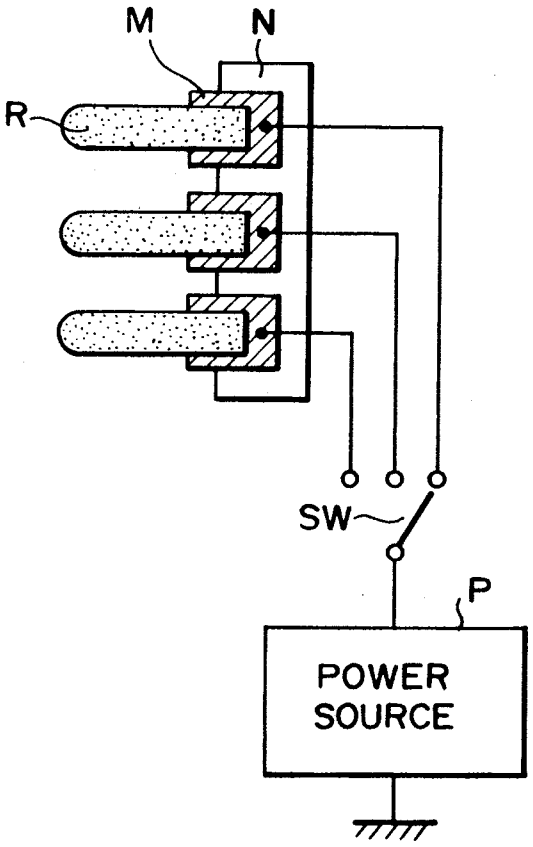
FIGS. 35A, 35B and 35C are a bottom view, a side elevation view, and a side elevation view, respectively, of the embodiment of Applicants' invention shown in FIG. 27 with the exception that each of the three parallel resistors has a different length and that voltages are selectively applied to the three resistors via a switch.
Figure 35A:
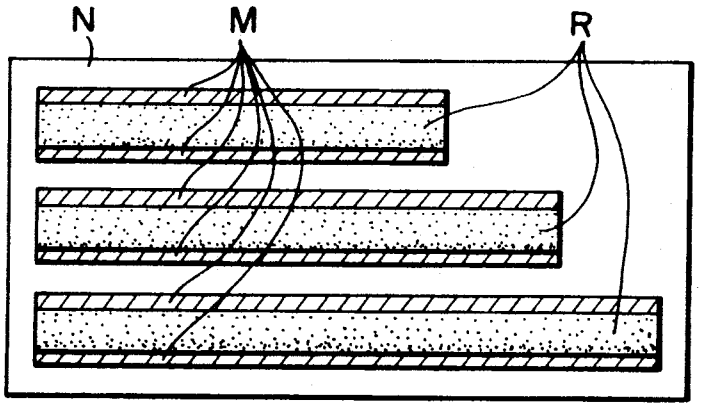
Figure 35B:
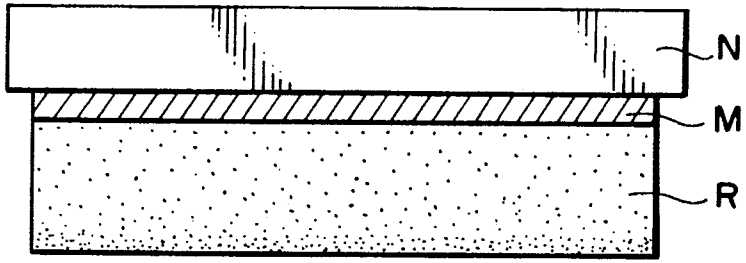

FIGS. 35A to 35C show an alternative embodiment of the present invention in a bottom view, a side elevation, and a side elevation as viewed in a different direction, respectively. This embodiment is essentially to the embodiment of FIG. 27 except that each of the three parallel resistors R has a different length, and that the voltage is selectively applied to the three resistors R via a switch SW so as to change over the charging width. The switch SW is connected between the power source P and the resistors R.

Figure 36A:
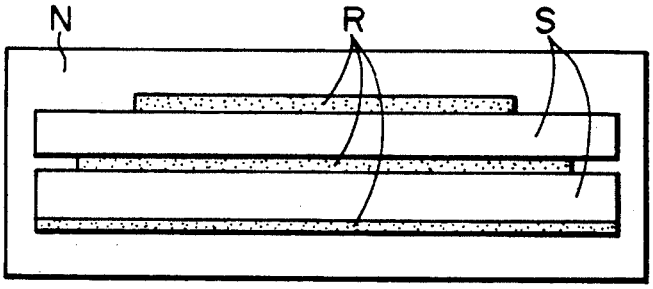
FIGS. 36A and 36B are a side view and a schematic circuit diagram, respectively, of a discharging member shown in FIG. 31C modified by each of three parallel resistors with a different length.
Figure 36B:
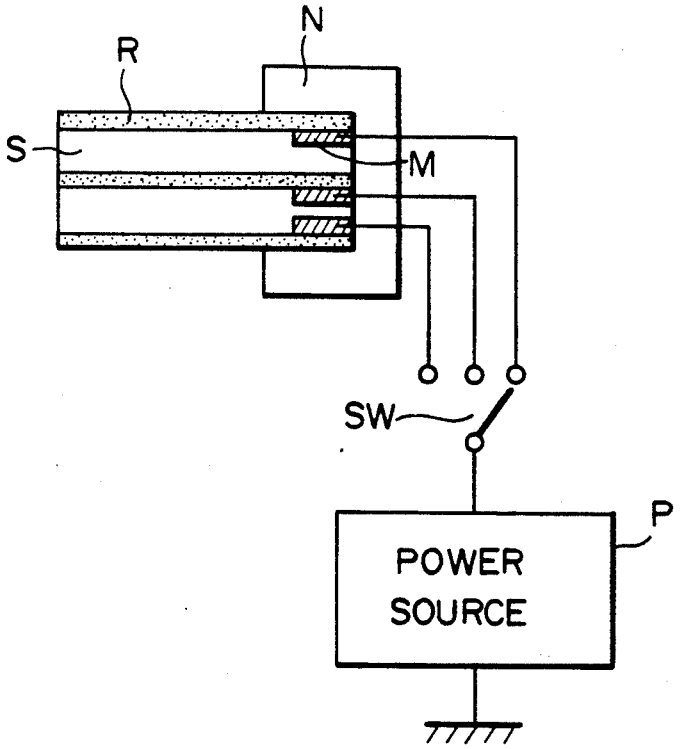

Further, FIGS. 36A and 36B show an alternative embodiment of the present invention in which the discharging member shown in FIG. 31C is modified to provide each of the three parallel resistors R with a different length. Again, the voltage is selectively applied to the resistos R via a switch SW to change over the charging width. The discharging member is shown in a bottom view in FIG. 36A and in a side elevation in FIG. 36B.

In summary, the present invention achieves various unprecedented advantages, as enumerated below.

(1) Since the surface of a resistor is used as a discharging end, the resistor forms a resistance matrix and thereby eliminates local discharge breakdown particular to a conductive discharge electrode. Even when the gap between the discharging end an an object is locally stopped by a conductor or when they are caused into contact, a discharge at the other portion is prevented from being interrupted. Energy is efficiently used to allow a minimum of ozone to be generated. The object is, therefore, free from mechanical, physical and chemical damage.

(2) When that surface of the discharging member which faces the object is partly covered with an insulative layer, the discharging member is immune to the influence of moisture and contamination.

(3) The gap between the discharging end and the object is maintained constant. This is realized by providing the discharging member with a spacer or by forming a conductive member and a resistor in a concentric configuration and fitting an annular insulative spacer on the outer periphery of the resistor which surrounds the conductive member. In the latter configuration, the discharging member is rotatable about the conductive member to maintain the spacer in contact with the object.

(4) The discharge gap may be defined by discharging elements which are provided on a substrate and at least one of which is implemented as a resistor. The substrate may be provided with a polygonal cross-section and arranged to be rotatable. This allows a plurality of discharge gaps to be selectively used as a discharging end and thereby substantially increases the service life of the discharging member while setting up a particular charging width which matches a paper size.

(5) The discharging member is easy to miniaturize. Hence, a plurality of discharging members may be arranged in parallel to set up a uniform charge distribution. Each discharging member may be provided with a different effective length to implement a particular charging width.

Various modifications will become possible for those skilled in the art after receiving the teachings of the present disclosure without departing from the scope thereof.

What is claimed is:

1. A discharging member located to face an object with the intermediary of a gap for charging, with a voltage being applied from a power source to each of said discharging member and said object, a surface of said object by a discharge which occurs in said gap, said discharging member comprising:

a body;

a resistor constituting one end of said body and defining a discharging end which faces the object with the intermediary of said gap, said resistor having a resistance in a range from $10^6$ Ω·cm to $10^{11}$ Ω·cm, wherein the surface of the object is charged by a discharge occurring between the object and the discharging end of the resistor which faces the object with the intermediary of the gap;

a connecting end connected to the power source at the other end of said body; and a conductive connector which connects said connecting end to said power source.

2. A discharging member as claimed in claim 1, further comprising a protective covering which covers a surface of said body.

3. A discharging member as claimed in claim 1, further comprising a conductive member connected between said conductive connector and said resistor.

4. A discharging member as claimed in claim 1, further comprising an insulative substrate which supports said resistor.

5. A discharging member as claimed in claim 1, wherein said discharging end of said resistor has a rectangular surface.

6. A discharging member as claimed in claim 1, wherein said discharging end of said resistor has a knife edge configuration.

7. A discharging member as claimed in claim 1, wherein said discharging end of said resistor has semicircular cross-section.

8. A charging device applied with a voltage from a power source for charging a surface of an object by a discharge which occurs between said charging device and said object, said charging device comprising:

a resistor one end of which defines a discharging end facing the object with the intermediary of a gap, said resistor having a resistance in a range from $10^6$ Ω·cm to $10^{11}$ Ω·cm, wherein the surface of the object is charged by a discharge occurring between the object and the discharging end of the resistor which faces the object with the intermediary of the gap; and a conductive connector connecting said resistor to the power source at the other end of said resistor.

9. A charging device as claimed in claim 8, further comprising a protective covering which covers a surface of said resistor.

10. A charging device as claimed in claim 8, further comprising a conductive member connected between said conductive connector and said resistor.

11. A charging device as claimed in claim 8, further comprising a conductive member which is surrounded by said resistor.

12. A charging device as claimed in claim 11, wherein said resistor and said conductive member are concentric in a section.

13. A charging device as claimed in claim 11, wherein said resistor surrounding said conductive member has a contour which is polygonal in cross-section.

14. A charging device as claimed in claim 13, wherein one of ridges of said polygonal contour of said resistor faces the object.

15. A charging device as claimed in claim 13, wherein said polygonal contour of of said conducive member comprises a polygonal star-like contour.

16. A charging device as claimed in claim 15, wherein apexes of said polygonal star-like contour are aligned with ridges of said polygonal contour of said resistor.

17. A charging device as claimed in claim 13, wherein at least one of said ridges of said polygonal cross-section is different in length from the other ridges.

18. A charging device as claimed in claim 8, further comprising an insulative substrate which supports said resistor.

19. A charging device as claimed in claim 8, wherein said discharging end of said resistor has a rectangular surface.

20. A charging device as claimed in claim 8, wherein said discharging end of said resistor has a knife edge configuration.

21. A charging device as claimed in claim 8, wherein said discharging end of said resistor has a semicircular cross-section.

22. A charging device applied with a discharge voltage from a discharge power source for charging a surface of an object by a discharge which occurs between said charging device and said object, said charging device comprising:

a substrate having a polygonal cross-section; and a plurality of discharging elements each being provided on respective one of surfaces of said substrate, at least one of said discharging elements provided on adjoining ones of said surfaces comprising a resistor and defining one discharge gap between said one discharging element and the other discharging element adjoining said one discharging element, said resistor having a resistance in a range from $10^6$ Ω·cm to $10^{11}$ Ω·cm, wherein the surface of the object is charged by a discharge occurring between the object and the discharging end of the resistor which faces the object with the intermediary of the gap;

wherein said substrate is mounted on said charging device to be rotatable about an axis of said substrate, whereby said discharge gaps between adjoining ones of said discharging elements are selectively used.

23. A charging device as claimed in claim 22, wherein said other discharging element comprises a conductor.

24. A charging device as claimed in claim 22, further comprising a conductive member for applying the discharge voltage from said discharge power source to said resistor.

25. A charging device as claimed in claim 22, further comprising control means for selectively applying the discharge voltage to selected one of said discharge gaps only.

26. A charging device as claimed in claim 25, wherein said control means comprises a switch.

27. A charging device applied with a discharge voltage from a discharge power source for charging a surface of an object by a discharge which occurs between said charging element and said object, said charging device comprising:

a plurality of discharging elements comprising resistors arranged in parallel with each other, one end of each of said discharging elements constituting a discharging end that faces the object with the intermediary of a gap, each resistor having a resistance in a range from $10^6$ Ω·cm to $10^{11}$ Ω·cm, wherein the surface of the object is charged by a discharge occurring between the object and the discharging end of the resistor which faces the object with the intermediary of the gap;

a conductive member holding the other end of said plurality of discharging members for applying the discharge voltage from the discharge power source to said discharging ends; and control means for selectively applying the discharge voltage from the discharge power source to said plurality of discharging elements.

28. A charging device as claimed in claim 27, wherein each of said discharging elements has a different length.

29. A charging device as claimed in claim 27, said control means comprises a switch.

30. A discharging member located to face an object with the intermediary of a gap for charging, with a voltage being applied from a power source to each of said discharging member and said object, a surface of said object by a discharge which occurs in said gap, said discharging member comprising:

a conductive member a resistor covering said conductive member, having a portion which faces the object with the intermediary of a gap, and having a resistance in a range from $10^6$ Ω·cm to $10^{11}$ Ω·cm;

means connecting said conductive member to a power source; and the surface of said object being charged by a discharge occurring between said object and said portion of said resistor.

31. A discharging member as claimed in claim 30, wherein said resistor and said conductive member are concentric in a section.

32. A discharging member as claimed in claim 30, wherein said resistor surrounding said conductive member has a contour which is polygonal in cross-section.

33. A discharging member as claimed in claim 32, wherein one of ridges of said polygonal contour of said resistor faces the object.

34. A discharging member as claimed in claim 32, wherein said polygonal contour of of said conductive member comprises a polygonal star-like contour.

35. A discharging member as claimed in claim 34, wherein apexes of said polygonal star-like contour are aligned with ridges of said polygonal contour of said resistor.

36. A discharging member as claimed in claim 32, wherein at least one of said ridges of said polygonal cross-section is different in length from the other ridges.

* * * * *